US007498949B2

(12) United States Patent
Ito et al.

(10) Patent No.: US 7,498,949 B2
(45) Date of Patent: Mar. 3, 2009

(54) FIRE SENSOR AND FIRE SENSOR STATUS INFORMATION ACQUISITION SYSTEM

(75) Inventors: Takashi Ito, Tokyo (JP); Yoshihiro Kumakura, Tokyo (JP)

(73) Assignee: Nohmi Bosai Ltd., Tokyo (JP)

( * ) Notice: Subject to any disclaimer, the term of this patent is extended or adjusted under 35 U.S.C. 154(b) by 85 days.

(21) Appl. No.: 11/649,287

(22) Filed: Jan. 4, 2007

(65) Prior Publication Data

US 2007/0115110 A1 May 24, 2007

Related U.S. Application Data

(62) Division of application No. 11/088,803, filed on Mar. 25, 2005, now Pat. No. 7,280,039.

(30) Foreign Application Priority Data

Mar. 30, 2004 (JP) ..... 2004-100358

(51) Int. Cl.
*G08B 17/10* (2006.01)

(52) U.S. Cl. ..... 340/628; 340/505; 250/574

(58) Field of Classification Search ..... 340/628–630, 340/539.1, 539.22, 600, 516, 577, 584, 578, 340/505; 250/574, 381
See application file for complete search history.

(56) References Cited

U.S. PATENT DOCUMENTS

| | | | | |
|---|---|---|---|---|
| 4,622,540 | A * | 11/1986 | Guscott et al. | 340/521 |
| 5,148,158 | A * | 9/1992 | Shah | 340/641 |
| 5,497,009 | A * | 3/1996 | Torikoshi et al. | 340/630 |
| 5,670,946 | A * | 9/1997 | Ellwood et al. | 340/628 |
| 5,691,699 | A * | 11/1997 | Vane et al. | 340/578 |
| 5,694,208 | A * | 12/1997 | Ichikawa | 356/73 |
| 5,721,529 | A * | 2/1998 | Vane et al. | 340/628 |
| 6,326,880 | B1 | 12/2001 | Tice | |
| 6,420,973 | B2 * | 7/2002 | Acevedo | 340/628 |
| 6,469,623 | B2 * | 10/2002 | Pattok et al. | 340/516 |
| 6,577,242 | B2 | 6/2003 | Jen et al. | |
| 6,838,988 | B2 * | 1/2005 | Lennartz et al. | 340/628 |
| 7,109,879 | B2 * | 9/2006 | Stults et al. | 340/691.1 |
| 2002/0101345 | A1 * | 8/2002 | Pattok et al. | 340/628 |
| 2002/0126016 | A1 * | 9/2002 | Sipp | 340/628 |
| 2002/0186141 | A1 | 12/2002 | Jen et al. | |

FOREIGN PATENT DOCUMENTS

| | | |
|---|---|---|
| EP | 0 248 957 | 12/1987 |
| JP | 5-225458 | 9/1993 |
| JP | 7-175984 | 7/1995 |
| JP | 7-262467 | 10/1995 |
| JP | 2002-135856 | 5/2002 |
| JP | 2004-38647 | 2/2004 |
| WO | 02/054366 | 7/2002 |

* cited by examiner

*Primary Examiner*—Eric M Blount
(74) *Attorney, Agent, or Firm*—Wenderoth, Lind & Ponack, L.L.P.

(57) ABSTRACT

A status information determining and outputting means updates the oldest data stored in a memory using a captured A/D value, finds a average value of six stored data items by calculation, and stores the calculated value in the memory as a current sensitivity. A status information transmitting means determines which grade of sensitivity level within a sensitivity tolerance range the current sensitivity data matches, sets a pulse spacing corresponding to the matched grade of sensitivity level, and make two pulses emit from a sensitivity data transmitting light-emitting element using the set pulse spacing.

2 Claims, 27 Drawing Sheets

3.5S
10.5S
5ms

ON
OFF

ON
OFF
FIRE BREAKS OUT

ON
OFF
POWER FAILURE/DISCON-
NECTION OCCURS
100ms

ON
OFF
SENSITIVITY OUTSIDE RANGE

ON
OFF
(P1+P2)
T1=30s

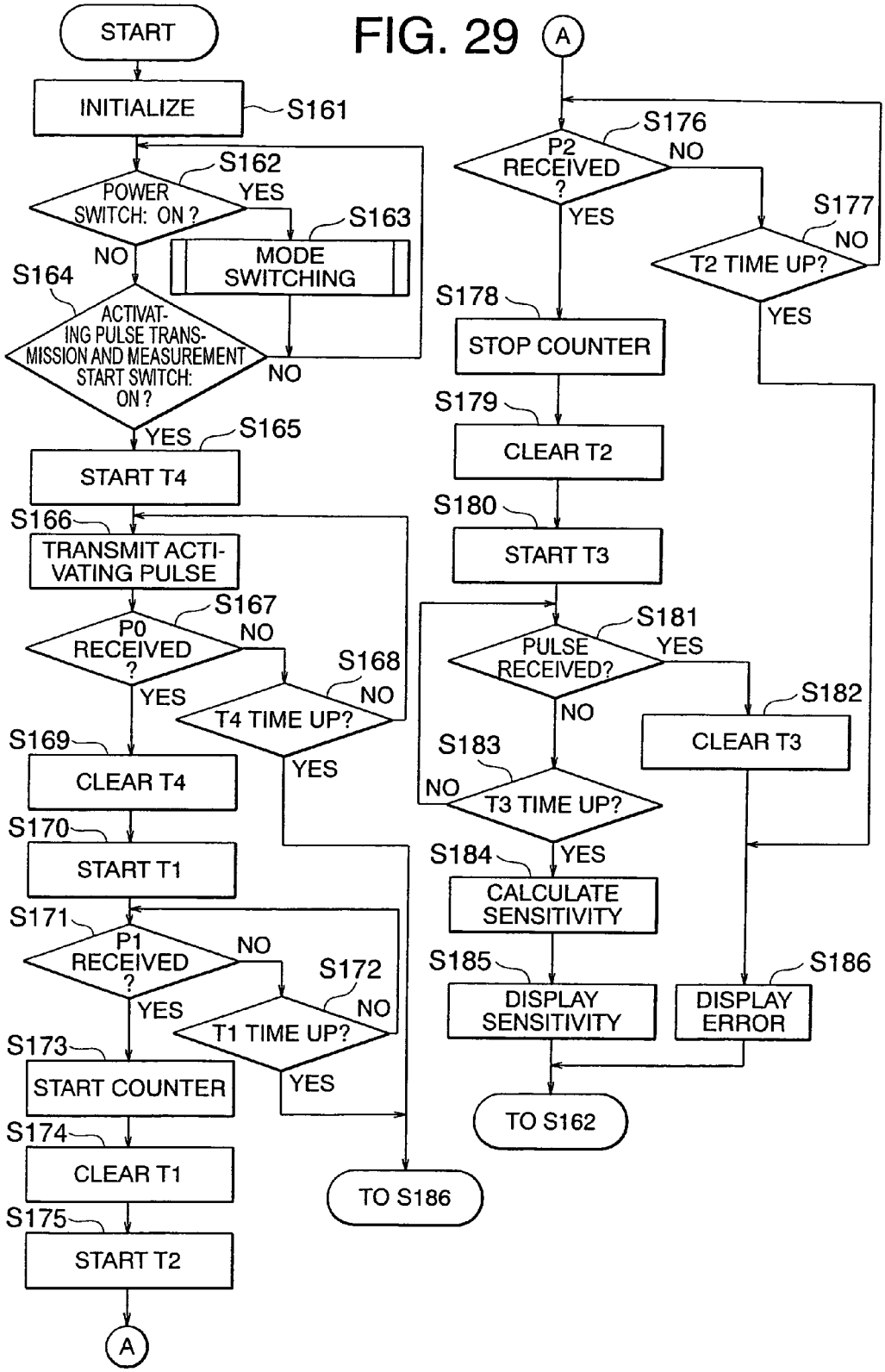
FIG. 29
START
INITIALIZE
S161
S162
POWER SWITCH: ON ?
YES
NO
S163
MODE SWITCHING
S164
ACTIVATING PULSE TRANSMISSION AND MEASUREMENT START SWITCH: ON ?
NO
YES
S165
START T4
S166
TRANSMIT ACTIVATING PULSE
S167
P0 RECEIVED ?
NO
YES
S168
T4 TIME UP?
NO
YES
S169
CLEAR T4
S170
START T1
S171
P1 RECEIVED ?
NO
YES
S172
T1 TIME UP?
NO
YES
S173
START COUNTER
S174
CLEAR T1
S175
START T2
A
TO S186
A
S176
P2 RECEIVED ?
NO
YES
S177
T2 TIME UP?
NO
YES
S178
STOP COUNTER
S179
CLEAR T2
S180
START T3
S181
PULSE RECEIVED?
YES
NO
S182
CLEAR T3
S183
T3 TIME UP?
NO
YES
S184
CALCULATE SENSITIVITY
S185
DISPLAY SENSITIVITY
S186
DISPLAY ERROR
TO S162

3.5S
10.5S
5ms

ON
OFF

ON
OFF
FIRE BREAKS OUT

ON
OFF
POWER FAILURE/DISCON-
NECTION OCCURS
100ms

ON
OFF
SENSITIVITY OUTSIDE RANGE

ON
OFF
(P0)
(P1+P2)
ACTIVATING PULSE
TRANSMISSION
CONTINUES
T1=30s
T4=10s

FIRE SENSOR AND FIRE SENSOR STATUS INFORMATION ACQUISITION SYSTEM

This is a divisional application of Ser. No. 11/088,803, filed Mar. 25, 2005, now U.S. Pat. No. 7,280,039.

BACKGROUND OF THE INVENTION

1. Field of the Invention

The present invention relates to a fire sensor and a fire sensor status information acquisition system installed in various monitored spaces of various portions of a building, for announcing the outbreak of fire if smoke is detected, for example, and particularly to a fire sensor and a fire sensor status information acquisition system, for transmitting sensitivity information constituting one type of status information.

2. Description of the Related Art

Conventional fire sensors, such as that described in Japanese Patent Laid-Open No. HEI 7-262467 (Gazette), for example, are connected to fire signal receivers by means of signal lines, and if a fire is detected, fire signals are output such that the fire signal receivers perform required fire alarm operations. As a method for receiving status information from fire sensors of this kind, in the case of systems communicating with the fire signal receivers using signal transmissions, if a call signal is received from a signal receiver, a transmitted signal in which the sensitivity data are encoded is sent back to the signal receiver and transmitted externally by making an infrared transmission indicator lamp emit light in response to data "zeros" and "ones" transmitted to the signal receiver.

In other conventional fire sensors, such as that described in U.S. Pat. No. 6,469,623 (Specifications), for example, sensitivity data from a smoke detector is transmitted externally by periodically making a light-emitting diode (LED) emit light using an encoded transmission signal.

However, in these conventional fire sensors, because the sensitivity data from detecting elements are encoded and transmitted externally by making a transmission indicator lamp, or an LED, etc., emit light, one problem has been that the number of light emissions by the transmission indicator lamp, the LED, etc., is extremely high, increasing electric power consumption.

In fire sensing systems, because fire sensors of this kind are installed in various monitored spaces inside a building, large numbers of fire sensors must be installed, and because electric power consumption by the system as a whole is large, there is demand for the electric power consumption of individual fire sensors to be reduced.

In conventional fire sensors such as that described in U.S. Pat. No. 5,721,529 (Specifications), warning threshold values and sensitivity limits are stored in a storage means in advance, and if output is outside the warning threshold values and sensitivity limits, an out-of-bounds signal is generated.

However, when a worker inspects the sensitivity status of such a conventional fire sensor using terminal equipment, the worker must receive a signal transmitted by the fire sensor with the terminal equipment, and inspect the sensitivity status of the fire sensor based on displayed contents displayed on the terminal equipment. The worker can only ascertain abnormal sensitivity of the fire sensor from the displayed contents on the terminal equipment, and one problem has been that it is difficult to arrive at a decision as to whether abnormal sensitivity has actually arisen in the fire sensor.

In conventional fire sensing apparatuses such as that described in U.S. Pat. No. 6,326,880 (Specifications), for example, an automatic test is performed on a fire sensor by admitting radiant energy such as light, etc., into the fire sensor from a tester.

However, in such conventional fire sensing apparatuses, information signals such as the sensitivity data of the detecting elements, etc., are constantly transmitted by a signal transmitting element in the fire sensor. Thus, one problem has been that operations relating to information acquisition for transmission must be performed by the fire sensor continuously, increasing power consumption.

SUMMARY OF THE INVENTION

In view of these conditions, an object of the present invention is to provide a fire sensor and a fire sensor status information acquisition system in which the number of signals transmitted by a signal transmitting element is reduced to reduce electric power consumption by setting temporal factors such as pulse duration, pulse spacing, for example, of pulses transmitted by the signal transmitting element based on sensitivity data and transmitting the sensitivity data externally by making the signal transmitting element generate pulses based on the set pulse temporal factors.

Another object of the present invention is to provide a fire sensor making it possible to determine clearly if abnormal sensitivity has actually occurred by disposing a warning means in the fire sensor and making the warning means warn that there is abnormal sensitivity, as well as transmitting notification of the abnormal sensitivity from the fire sensor, such that a checker can ascertain that the sensitivity is abnormal not only from displayed contents on terminal equipment but also from the warning means.

Yet another object of the present invention is to provide a system using a fire sensor in which electric power consumption is reduced by making the fire sensor cyclically check for presence or absence of a trigger signal, and carrying out an operation relating to information acquisition if the trigger signal is received.

In order to achieve the above object, according to one aspect of the present invention, there is provided a fire sensor including: a detecting portion for detecting a fire; a status information determining and outputting means for determining and outputting status information corresponding to a status of the detecting portion; a signal transmitting element for transmitting the status information by emitting a pulse externally; and a status information transmitting means for setting a temporal factor of the pulse based on the status information, and making the pulse emit from the signal transmitting element based on the set temporal factor.

Thus, pulse duration, pulse period, etc., constituting temporal factors of the pulse are set based on the status information corresponding to the status of the detecting portion, and the pulse is sent by the signal transmitting element using the set temporal factors such as pulse duration, pulse period, etc. Consequently, the number of signals transmitted by the signal transmitting element in order to transmit the status information of the detecting portion externally can be kept very low, achieving a fire sensor having low power consumption.

According to another aspect of the present invention, there is provided a fire sensor including: a detecting portion for detecting a fire; a sensitivity information preparing means for preparing sensitivity information corresponding to a status of the detecting portion; a warning means for warning that the sensitivity information is in an abnormal state; a sensitivity information determining means for determining whether the sensitivity information is in an abnormal state; and a sensitivity information transmitting means for transmitting the sensitivity information externally. If the sensitivity information determining means determines that the sensitivity information is in an abnormal state, the sensitivity information transmitting means transmits abnormality information instead of the sensitivity information and makes the warning means warn that the sensitivity information is in an abnormal state.

Thus, a checker can ascertain that the sensitivity is abnormal not only from displayed contents on terminal equipment but also from the warning of the abnormal sensitivity by the warning means, enabling the occurrence of abnormal sensitivity to be determined clearly.

According to yet another aspect of the present invention, there is provided a fire sensor status information acquisition system including: a fire sensor including: a detecting portion for detecting a fire; a status information determining and outputting means for determining and outputting status information corresponding to a status of the detecting portion; a signal transmitting element for transmitting the status information by emitting a pulse externally; and a status information transmitting means for making the pulse emit from the signal transmitting element based on the status information; and a signal receiving apparatus including: a status information acquiring means for acquiring the status information by receiving the pulse from the signal transmitting element; and a display for displaying the acquired status information. The status information transmitting means sets a pulse spacing corresponding to the status information, and transmits two of the pulses from the signal transmitting element within a predetermined timing using the pulse spacing; and the signal receiving apparatus displays the status information deduced from the pulse spacing on the display if only the two pulses are received within the predetermined timing, and displays an error on the display if three or more pulses are received within the predetermined timing, or if the pulses are received outside the predetermined timing.

Thus, a fire sensor status information acquisition system is achieved that enables false detection of the status information due to noise to be prevented.

According to still yet another aspect of the present invention, there is provided a fire sensor status information acquisition system including: a fire sensor including: a sensor signal receiving element for receiving a trigger signal; and a controlling means for checking cyclically whether or not the trigger signal has been received at the sensor signal receiving element and executing an operation relating to information acquisition if the trigger signal is received; and terminal equipment including a terminal equipment signal transmitting element for transmitting the trigger signal, the terminal equipment emitting the trigger signal from the terminal equipment signal transmitting element continuously for a length of time greater than or equal to the cycle of checking.

Thus, because the trigger signal is emitted from the terminal equipment signal transmitting element continuously for a length of time greater than or equal to the cycle of checking as to whether of not the trigger signal from the controlling means has been received, the controlling means can detect whether or not the trigger signal has been received within a timing corresponding to activation of a microcomputer, for example, without having to continuously check whether or not the trigger signal has been received, enabling electric power consumption to be reduced.

BRIEF DESCRIPTION OF THE DRAWINGS

FIG. 29 is a flow chart explaining operation of the sensitivity tester according to Embodiment 2 of the present invention.

DETAILED DESCRIPTION OF THE PREFERRED EMBODIMENTS

Preferred embodiments of the present invention will now be explained with reference to the drawings.

Embodiment 1

Figure 1:
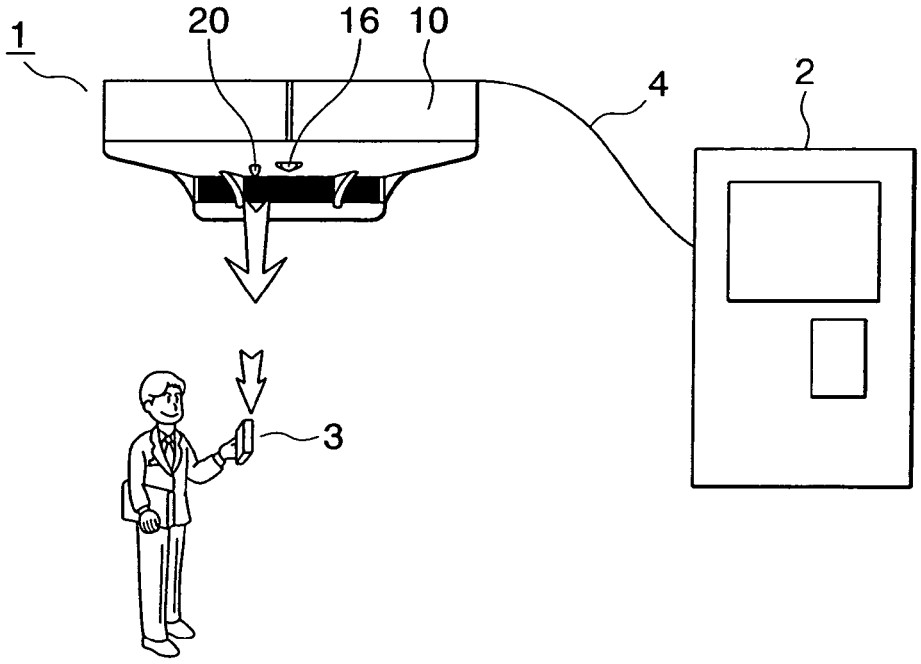
FIG. 1 is a system diagram schematically showing a fire sensor status information acquisition system according to Embodiment 1 of the present invention.
Figure 2:
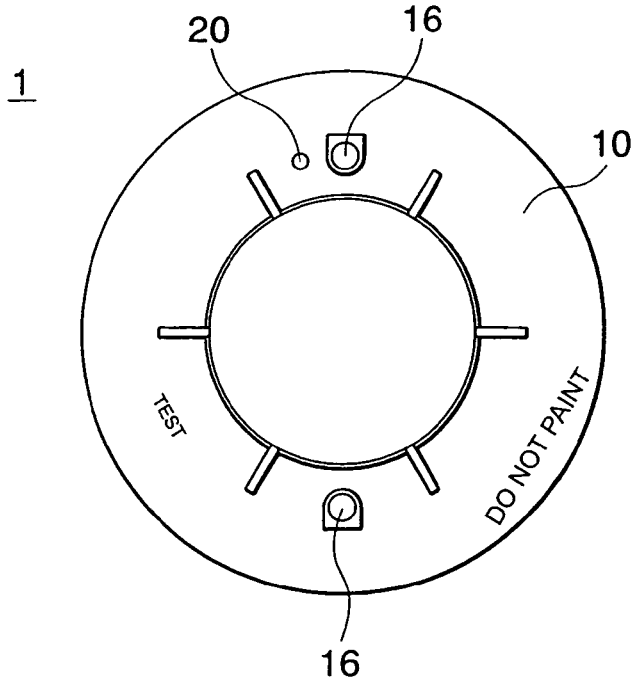
FIG. 2 is a front elevation showing a fire sensor according to Embodiment 1 of the present invention.
Figure 3:
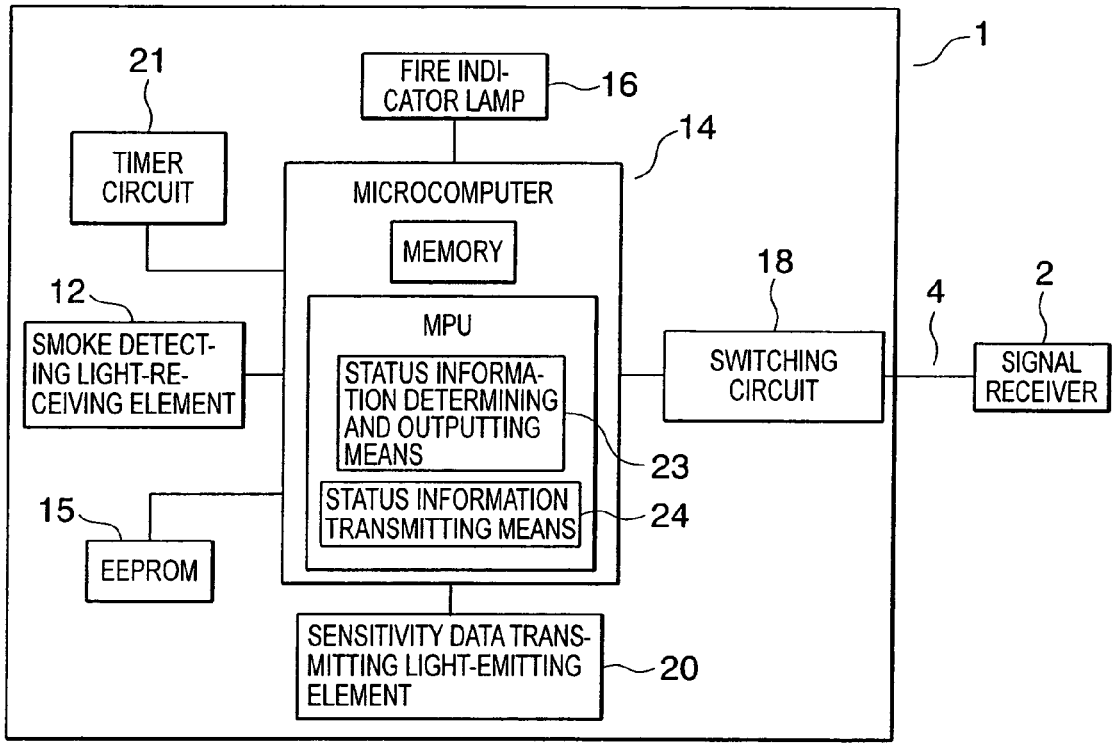
FIG. 3 is a block diagram schematically showing a configuration of the fire sensor according to Embodiment 1 of the present invention.
Figure 4:
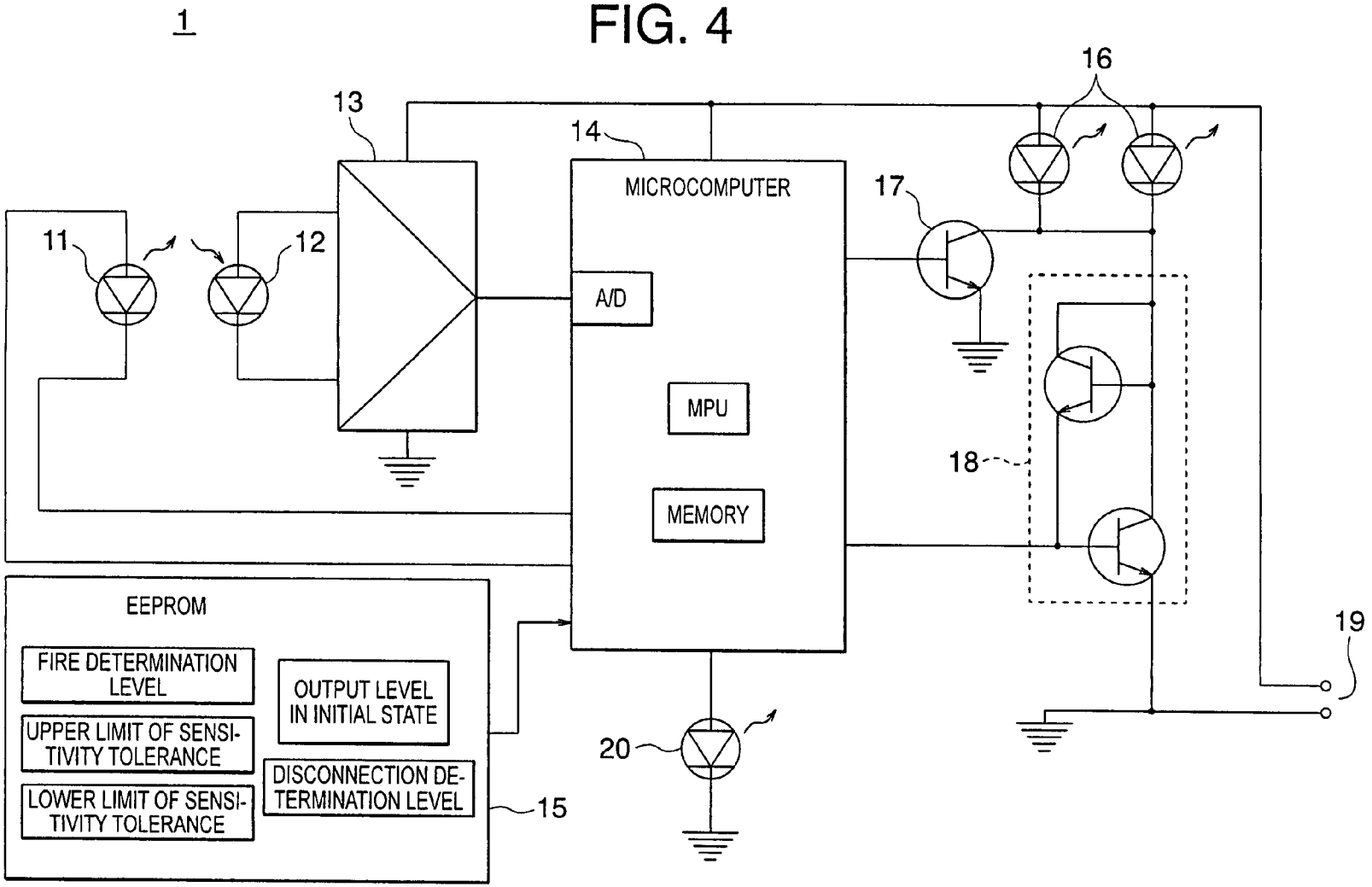
FIG. 4 is a block circuit diagram schematically showing a circuit configuration of the fire sensor according to Embodiment 1 of the present invention.
Figure 5:
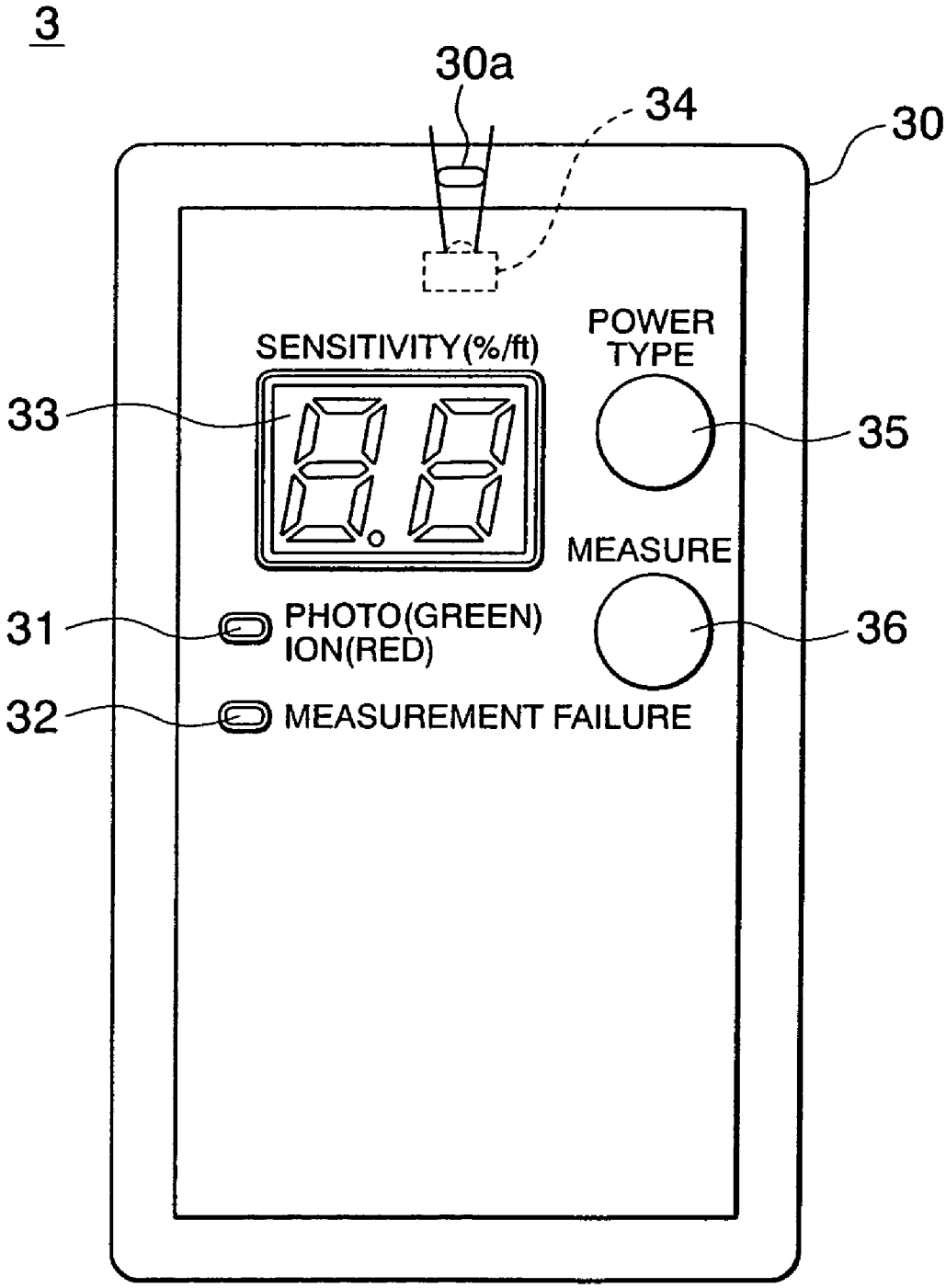
FIG. 5 is a front elevation showing a sensitivity tester according to Embodiment 1 of the present invention.
Figure 6:
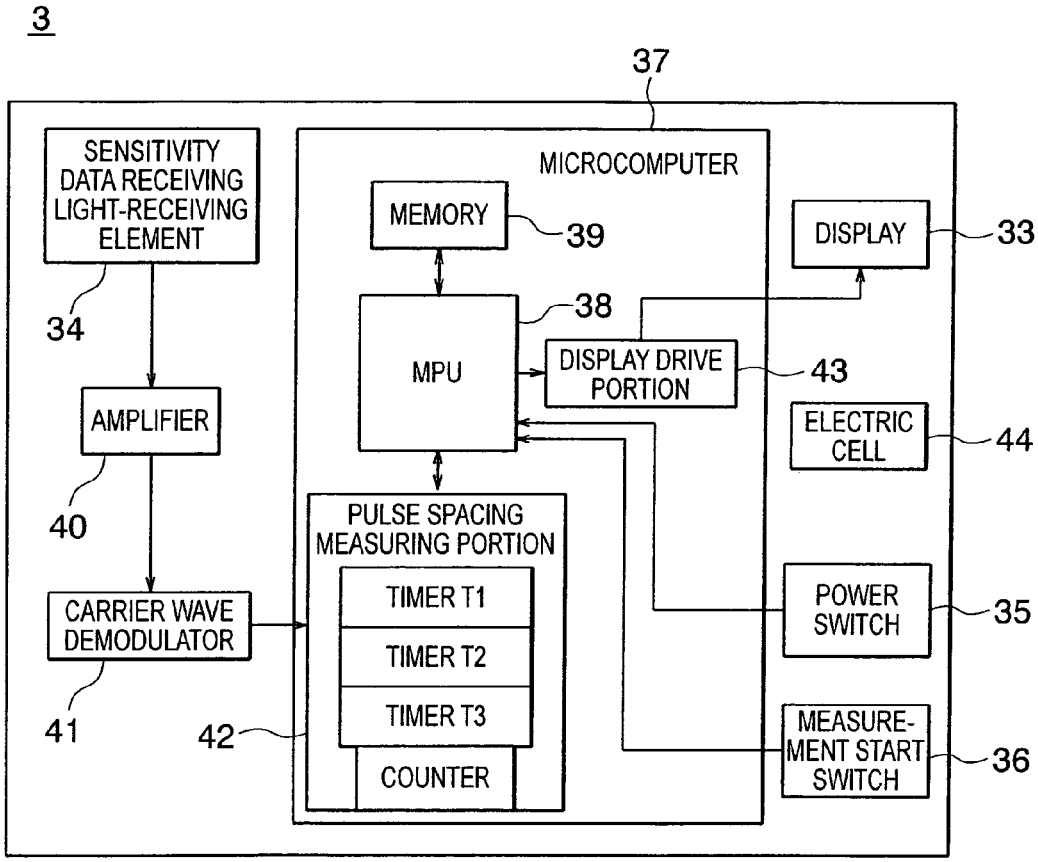
FIG. 6 is a block diagram schematically showing a configuration of the sensitivity tester according to Embodiment 1 of the present invention.
Figure 7:
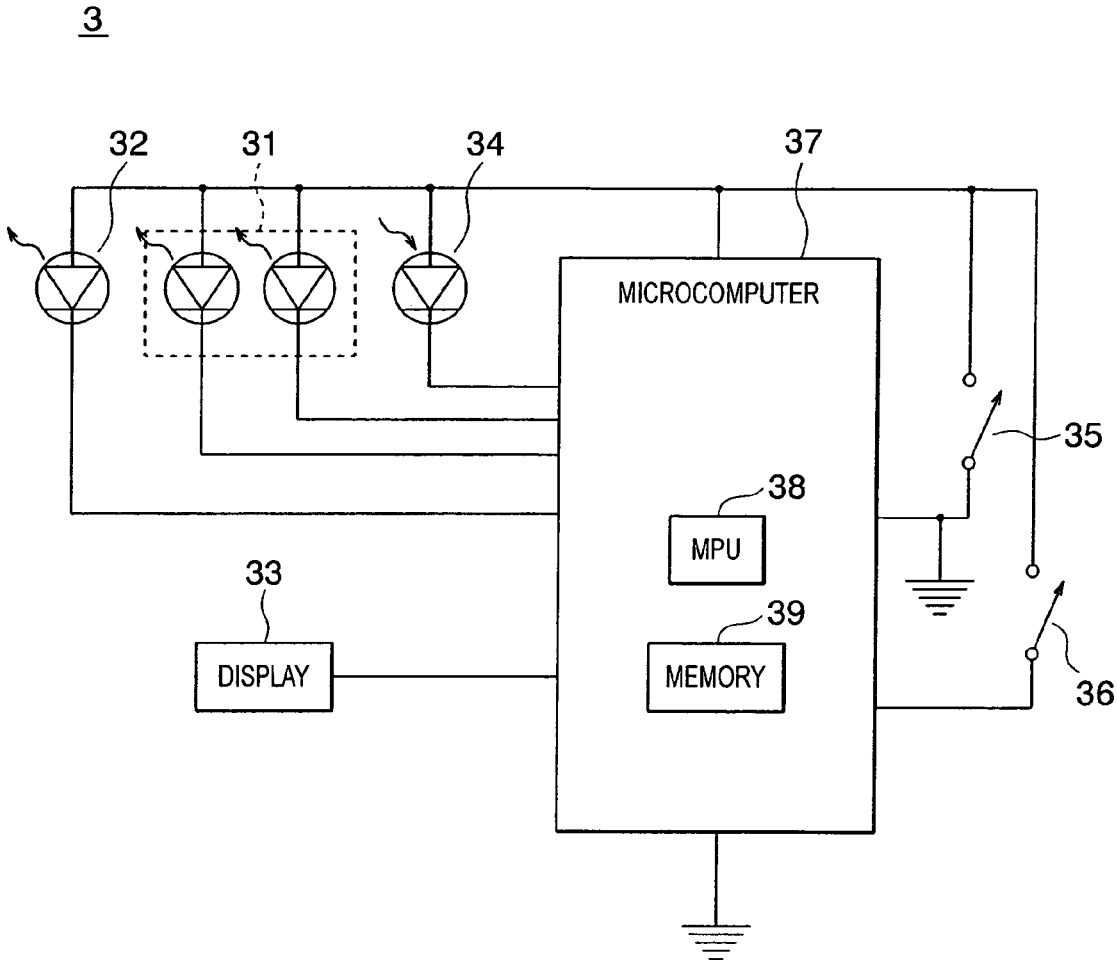
FIG. 7 is a block circuit diagram schematically showing a circuit configuration of the sensitivity tester according to Embodiment 1 of the present invention.
Figure 8:
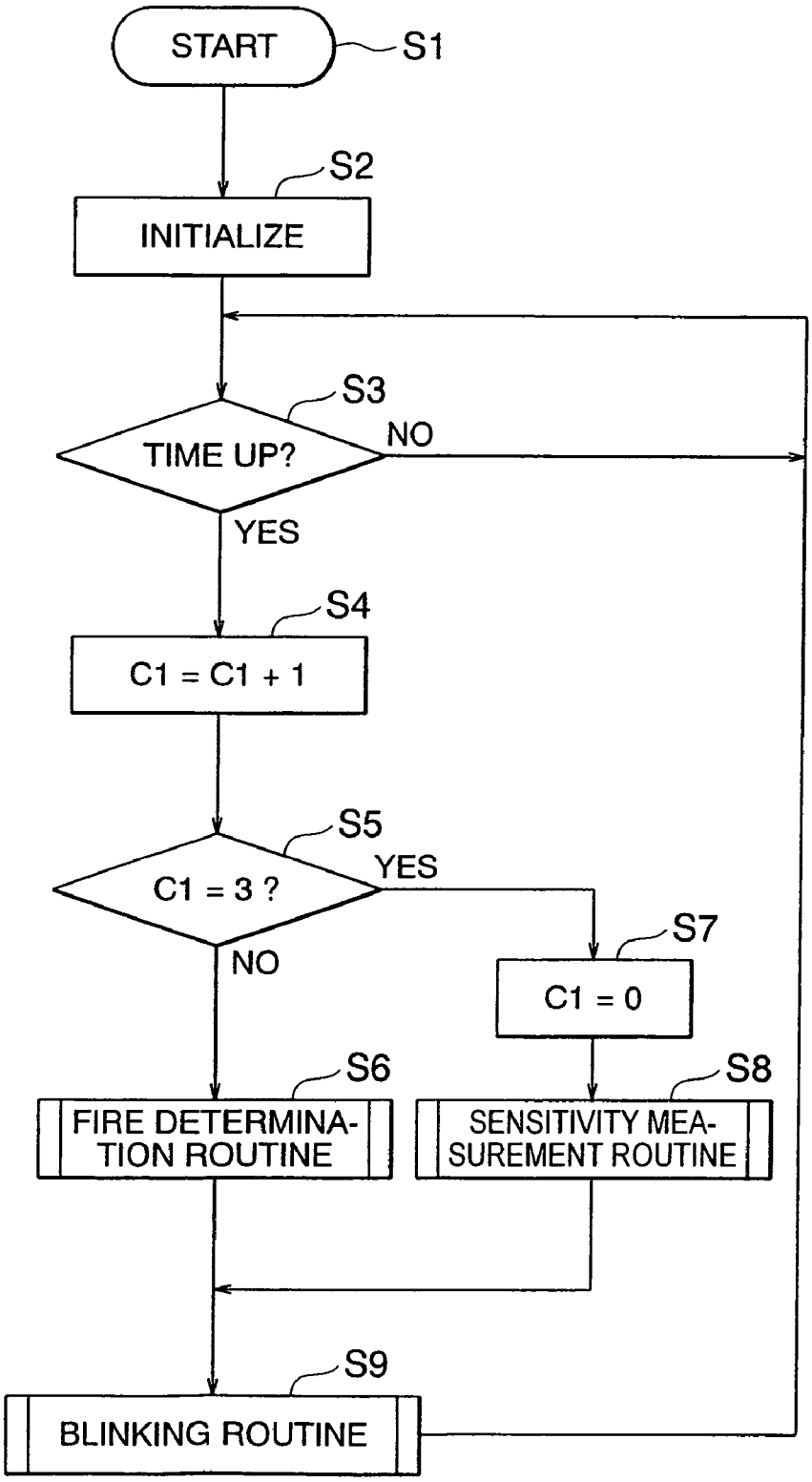
FIG. 8 is a flow chart explaining overall operation of the fire sensor according to Embodiment 1 of the present invention.
Figure 9:
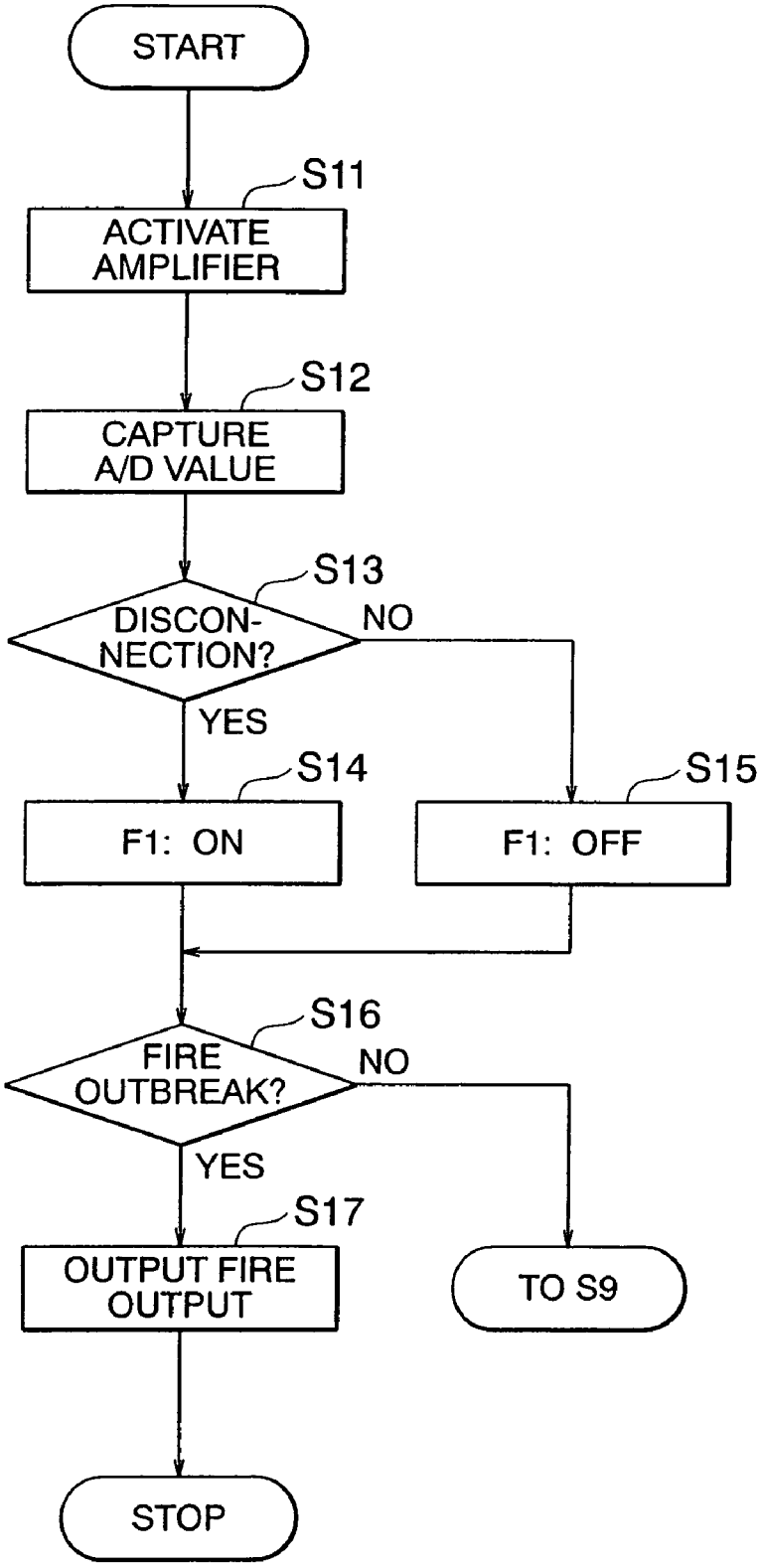
FIG. 9 is a flow chart explaining a fire determining operation in the fire sensor according to Embodiment 1 of the present invention.
Figure 10:
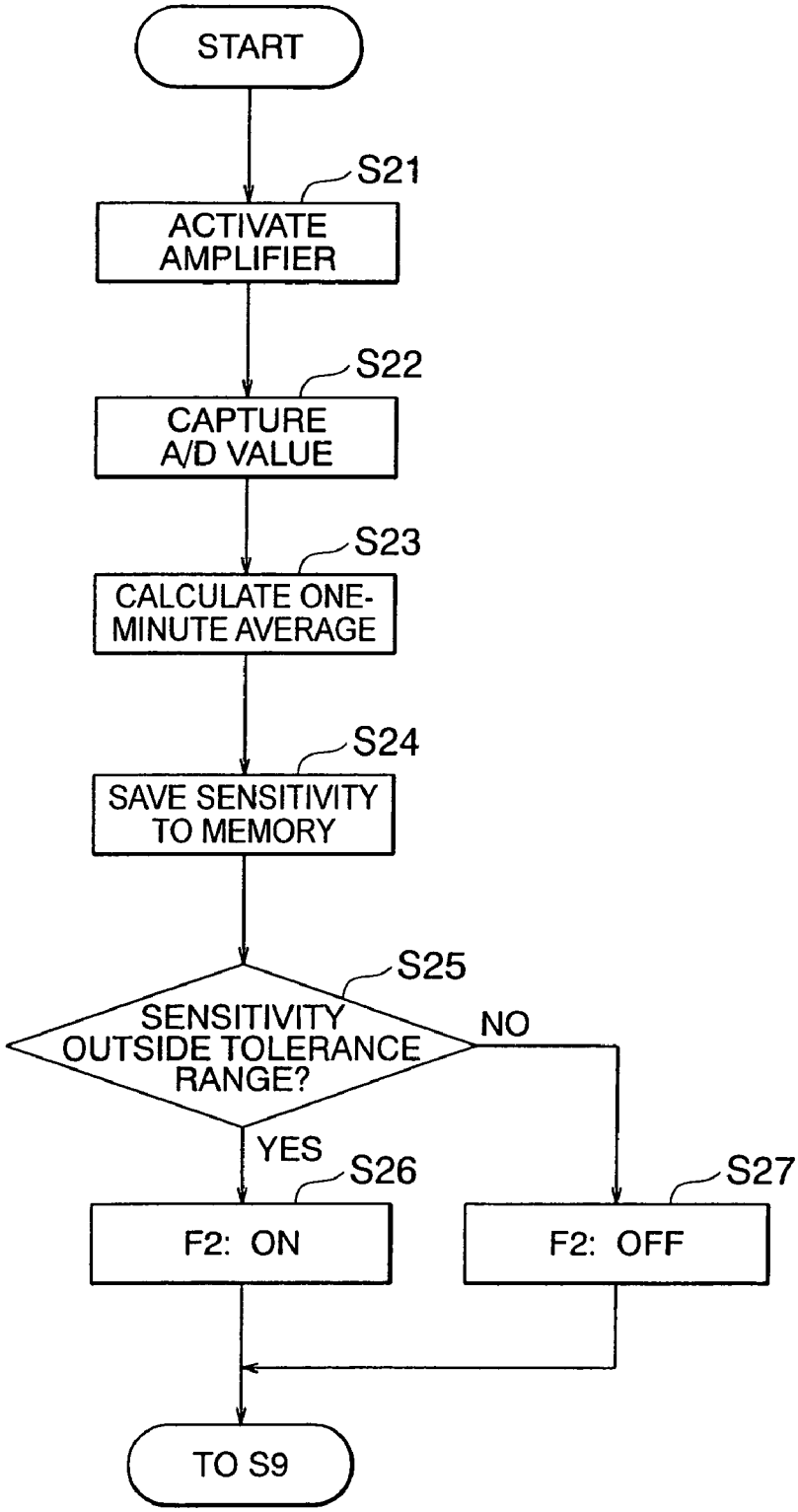
FIG. 10 is a flow chart explaining a sensitivity measuring operation in the fire sensor according to Embodiment 1 of the present invention.
Figure 11:
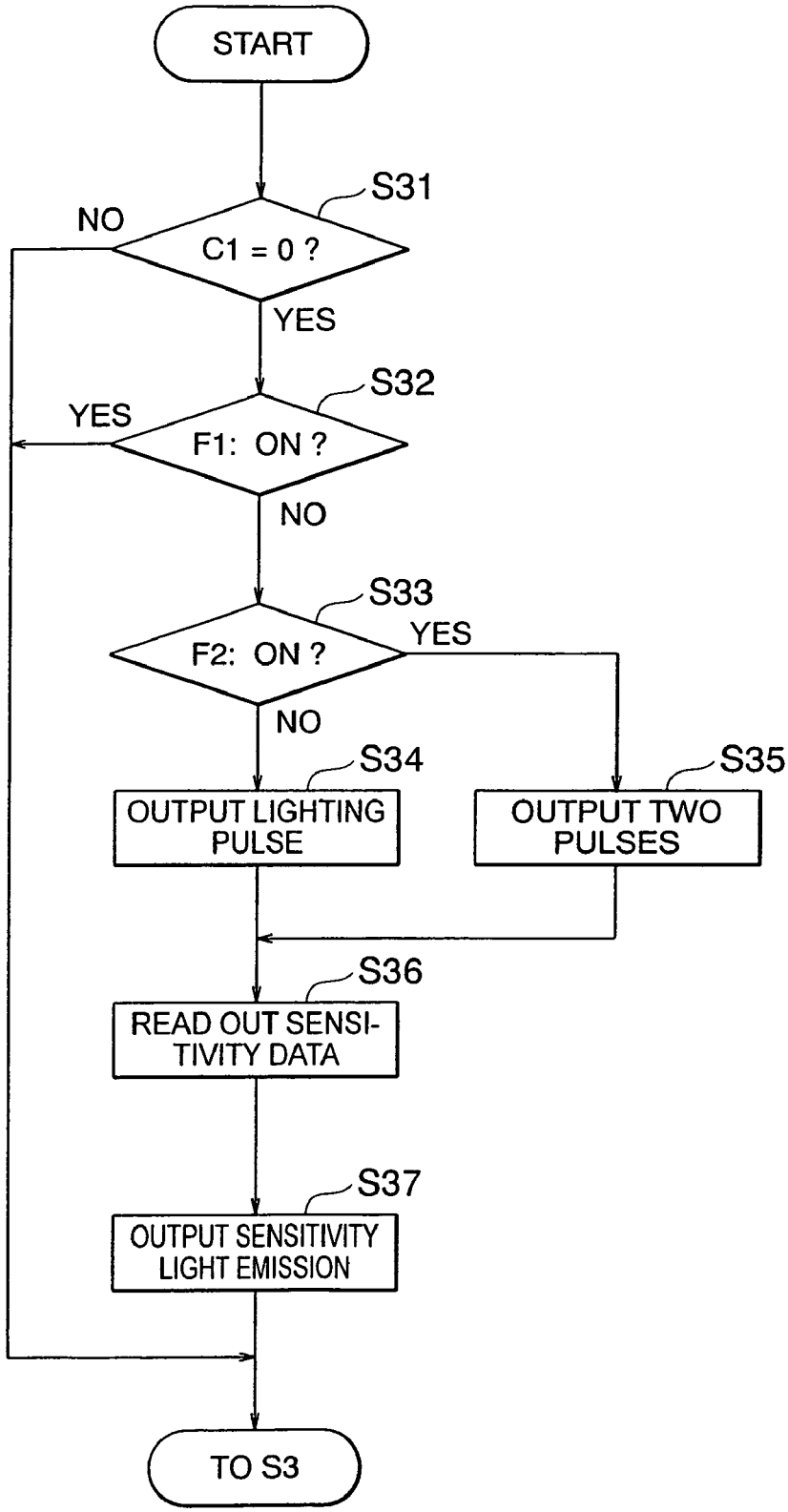
FIG. 11 is a flow chart explaining a blinking operation in the fire sensor according to Embodiment 1 of the present invention.
Figure 12:
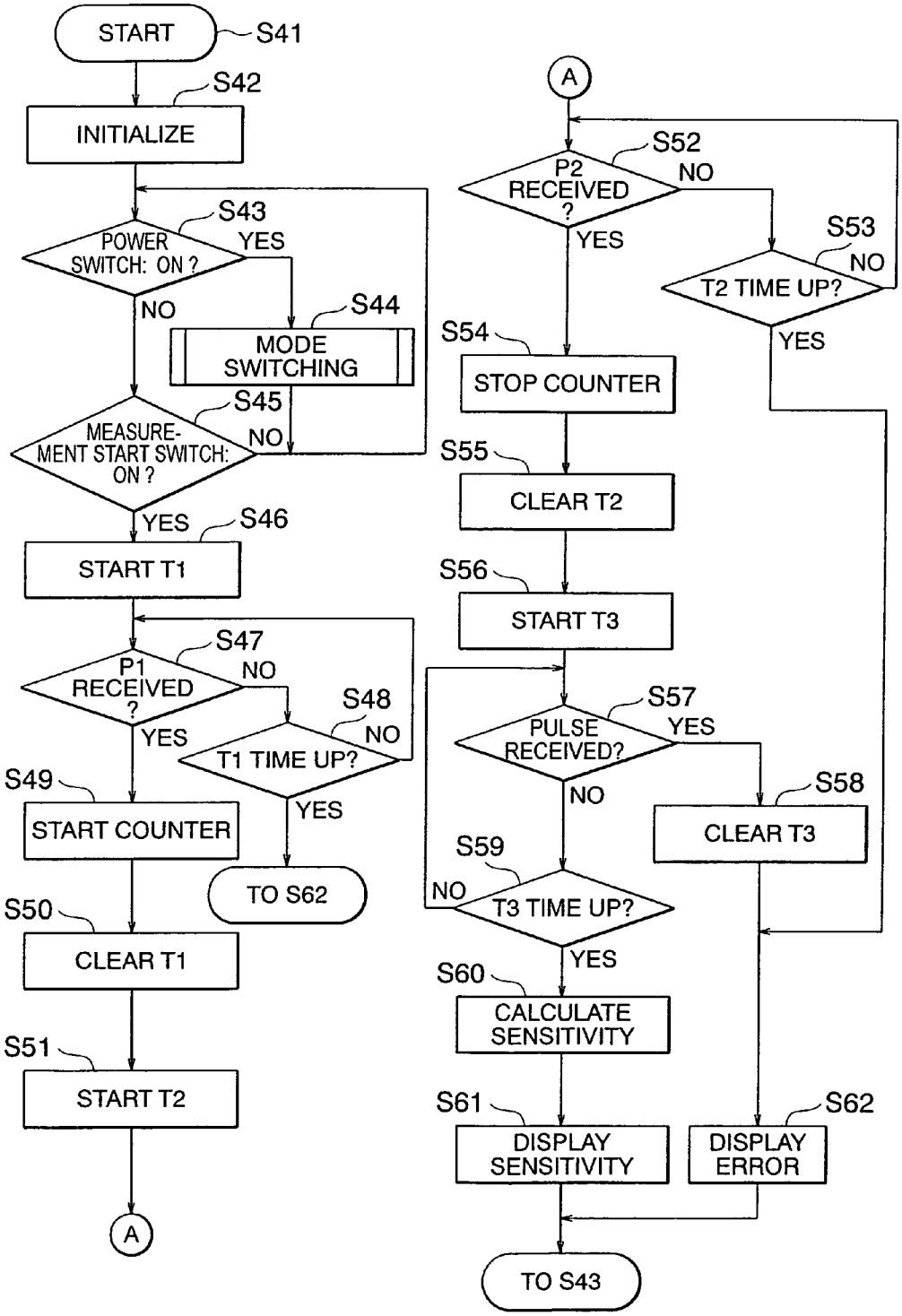
FIG. 12 is a flow chart explaining operation of the sensitivity tester according to Embodiment 1 of the present invention.
Figure 13:
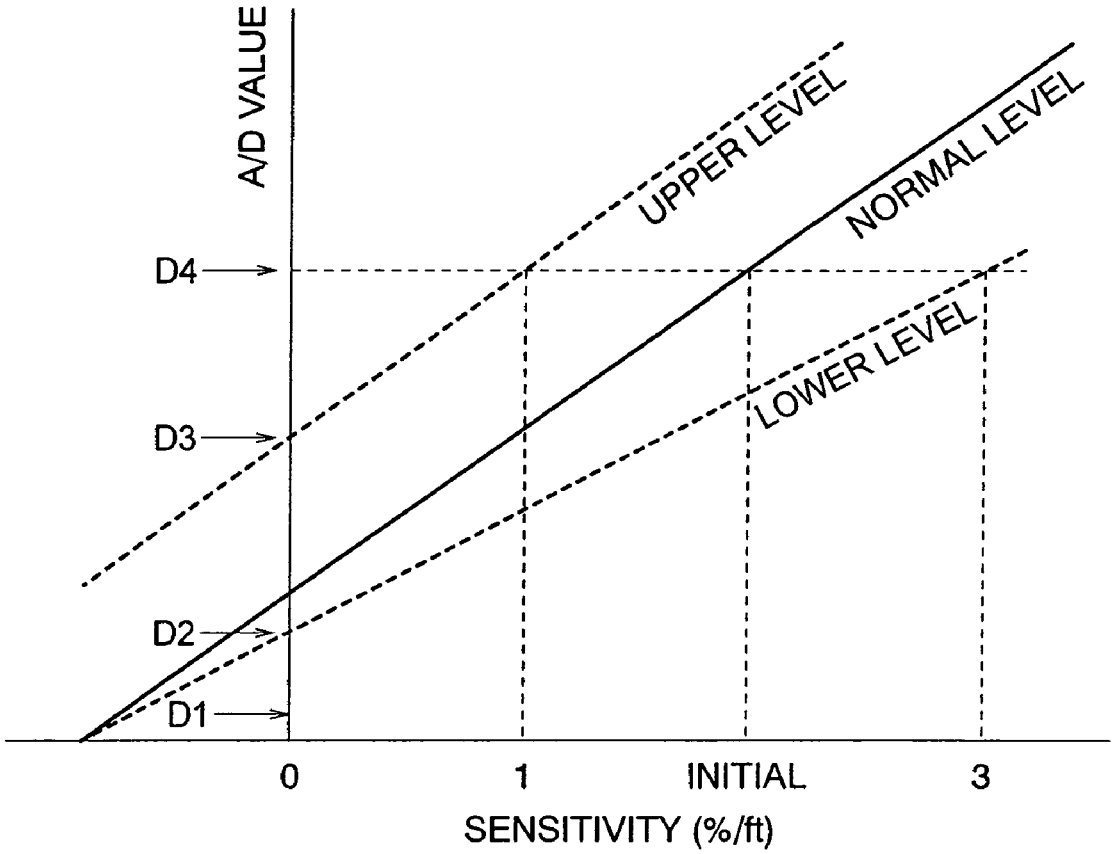
FIG. 13 is a graph explaining relationships between sensitivity and A/D values in the fire sensor according to Embodiment 1 of the present invention.
Figures 14A, 14B, 14C, 14D, 14E, 14F:
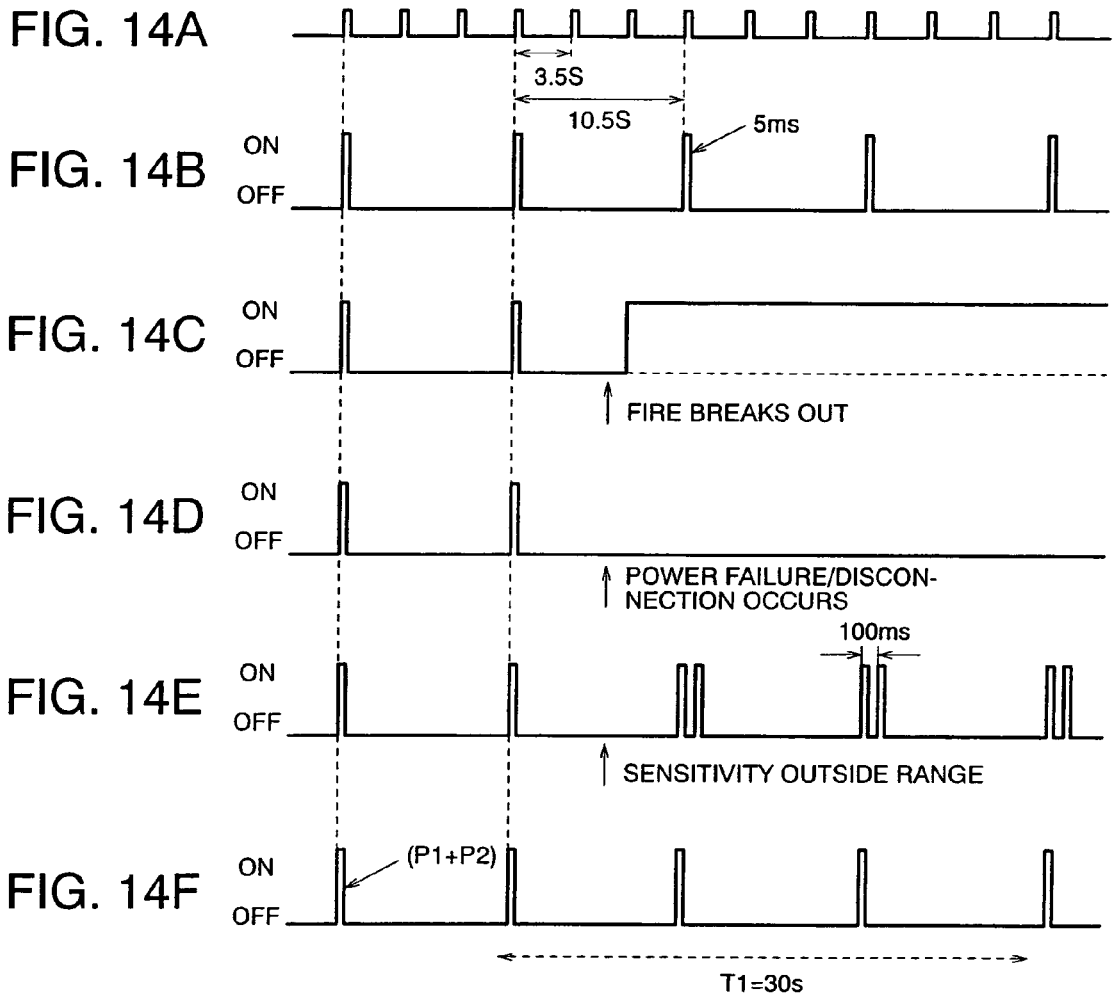
FIGS. 14A through 14F are timing charts explaining operation of a fire indicator lamp and a sensitivity data transmitting light-emitting element in the fire sensor according to Embodiment 1 of the present invention.
Figure 15:
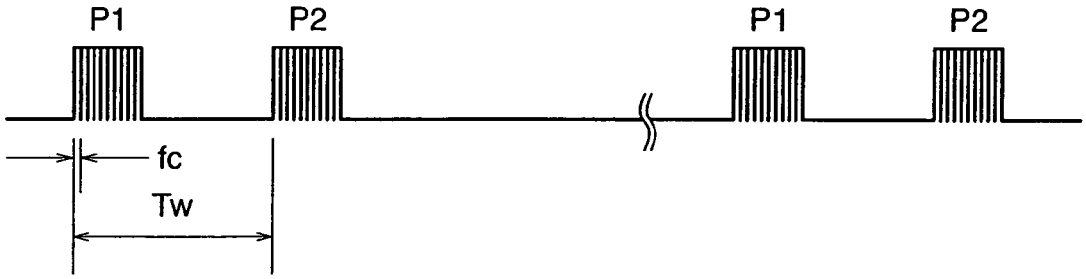
FIG. 15 is a diagram showing pulses output to the sensitivity data transmitting light-emitting element in the fire sensor according to Embodiment 1 of the present invention.
Figure 16A:
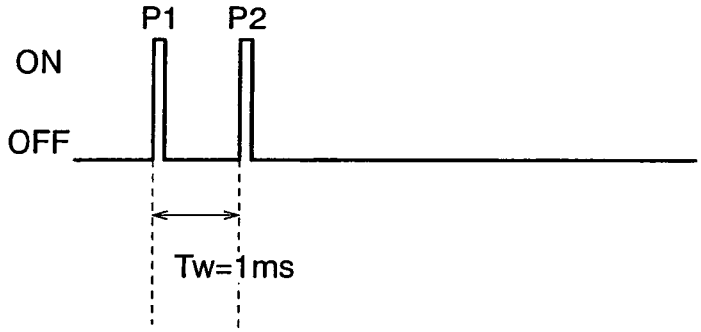
FIGS. 16A and 16B are timing charts explaining a set state of pulse spacing corresponding to sensitivity level in the fire sensor according to Embodiment 1 of the present invention.
Figure 16B:
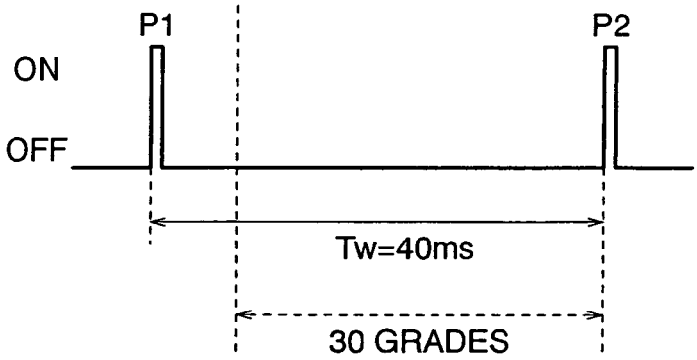
Figure 17A:
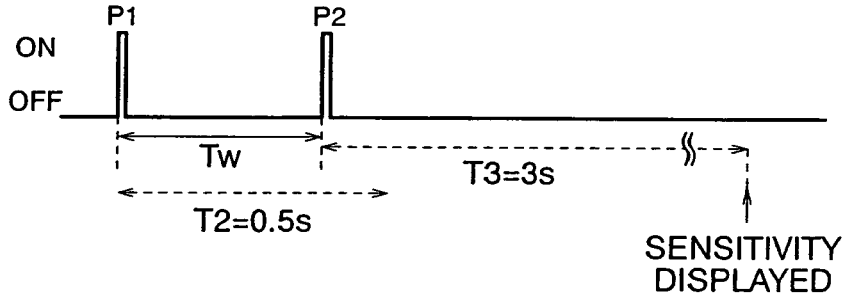
FIGS. 17A and 17B are timing charts explaining operation in the sensitivity tester according to Embodiment 1 of the present invention.
Figure 17B:
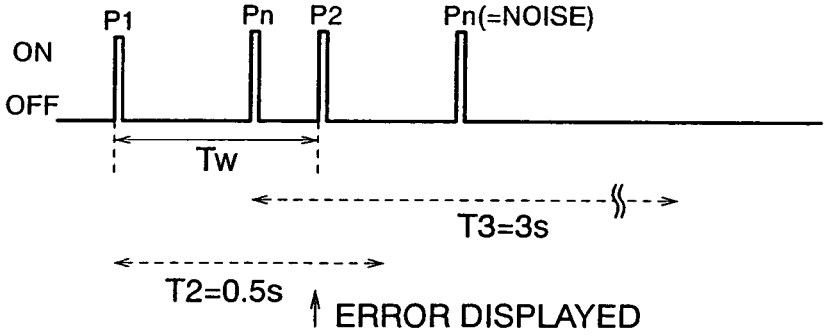

FIG. 1 is a system diagram schematically showing a fire sensor status information acquisition system according to Embodiment 1 of the present invention, FIG. 2 is a front elevation showing a fire sensor according to Embodiment 1 of the present invention, FIG. 3 is a block diagram schematically showing a configuration of the fire sensor according to Embodiment 1 of the present invention, FIG. 4 is a block circuit diagram schematically showing a circuit configuration of the fire sensor according to Embodiment 1 of the present invention, FIG. 5 is a front elevation showing a sensitivity tester according to Embodiment 1 of the present invention, FIG. 6 is a block diagram schematically showing a configuration of the sensitivity tester according to Embodiment 1 of the present invention, and FIG. 7 is a block circuit diagram schematically showing a circuit configuration of the sensitivity tester according to Embodiment 1 of the present invention. FIG. 8 is a flow chart explaining overall operation of the fire sensor according to Embodiment 1 of the present invention, FIG. 9 is a flow chart explaining a fire determining operation in the fire sensor according to Embodiment 1 of the present invention, FIG. 10 is a flow chart explaining a sensitivity measuring operation in the fire sensor according to Embodiment 1 of the present invention, FIG. 11 is a flow chart explaining a blinking operation in the fire sensor according to Embodiment 1 of the present invention, and FIG. 12 is a flow chart explaining operation of the sensitivity tester according to Embodiment 1 of the present invention. FIG. 13 is a graph explaining relationships between sensitivity and A/D values in the fire sensor according to Embodiment 1 of the present invention, FIGS. 14A through 14F are timing charts explaining operation of a fire indicator lamp and a sensitivity data transmitting light-emitting element in the fire sensor according to Embodiment 1 of the present invention, FIG. 15 is a diagram showing pulses output to the sensitivity data transmitting light-emitting element in the fire sensor according to Embodiment 1 of the present invention, FIGS. 16A and 16B are timing charts explaining a set state of pulse spacing corresponding to sensitivity level in the fire sensor according to Embodiment 1 of the present invention, and FIGS. 17A and 17B are timing charts explaining operation in the sensitivity tester according to Embodiment 1 of the present invention.

In FIG. 1, a fire sensor status information acquisition system is constituted by: a fire sensor 1 mounted to a ceiling, for example, for sensing a fire; a fire signal receiver 2 connected to the fire sensor 1 by a power and signal line 4, the fire signal receiver 2 supplying electric power to the fire sensor 1 and receiving a fire signal from the fire sensor 1; and a sensitivity tester 3 functioning as a signal receiving apparatus and terminal equipment for receiving and displaying a status signal from the fire sensor 1 when a checker checks the status of a detecting portion of the fire sensor 1. Moreover, here a case is shown in which sensitivity data functioning as sensitivity information among status information is used as a status signal.

Next, a configuration of the fire sensor 1 will be explained with reference to FIGS. 2 through 4. Moreover, a smoke detector is used here for the fire sensor 1.

A smoke detecting light-emitting element 11 is a light-emitting diode (LED) emitting light to detect smoke, and a smoke detecting light-receiving element 12 is the photo diode for receiving the light emitted by the smoke detecting light-emitting element 11. The smoke detecting light-emitting element 11 and the smoke detecting light-receiving element 12 are installed inside a black box (not shown) disposed inside a main body 10 to constitute a smoke detecting portion. This black box includes a labyrinth which smoke enters. The light emitted by the smoke detecting light-emitting element 11 is scattered by smoke particles that have entered through the labyrinth, and this scattered light is received by the smoke detecting light-receiving element 12. Output from the smoke detecting light-receiving element 12 is amplified by an amplifier 13.

A microcomputer 14 is a circuit chip for controlling overall operation of the fire sensor 1, includes: a microprocessor (MPU); and a storage means (memory) for holding data in an interior portion, and has: a plurality of ports for conducting input and output to respective portions; and an analog-to-digital converter (A/D). The microcomputer 14 performs analog-to-digital conversion on the output from the amplifier 13 and captures it as data (an A/D value). Here, the microcomputer 14 switches a gain of the amplifier 13 so as to be higher during sensitivity measurement than during fire determination.

An electrically erasable programmable read-only memory (EEPROM) 15 is a rewritable nonvolatile memory, and a fire determination level, an output level in an initial state, a disconnection determination level relating to a smoke detecting function, upper limit and lower limit levels of a sensitivity tolerance range, etc., are stored therein as data to be compared with the A/D values. These data are adjusted for sensitivity and written during manufacturing.

A fire indicator lamp 16 warns visually that a fire (smoke) has been detected, and constitutes a warning means for warning if there is an abnormal state, and an LED emitting visible light such as red light, etc., being used therein. Two of these fire indicator lamps 16 are disposed on external surfaces of the main body 10 so as to be visible from any direction at a site where the fire sensor 1 is installed.

A blinking transistor 17 receives a pulsed output from the microcomputer 14, and switches on cyclically at intervals of 10.5 seconds, for example. Thus, the fire indicator lamp 16 is lit cyclically (blinking) at intervals of 10.5 seconds, for example, making it possible to determine visually whether the fire sensor 1 is operating.

A switching circuit 18 is a self-holding circuit that is switched on based on output from the microcomputer 14 if a fire is detected. By holding this switching circuit 18 in an ON state, impedance between a pair of power and signal lines 4 from the fire signal receiver 2 is changed from a high impedance to a low impedance, transmitting a fire signal to the fire signal receiver 2. Simultaneously with the transmission of this fire signal, the fire indicator lamp 16 lights up continuously.

Terminals 19 are terminals to which the pair of power and signal lines 4 from the fire signal receiver 2 are connected, and serve as both fire signal output terminals and electric power terminals.

A sensitivity data transmitting light-emitting element 20 functioning as a sensor signal transmitting element is an infrared LED for transmitting sensitivity data, and emits light (transmits) cyclically at intervals of 10.5 seconds, for example, in synchrony with the lighting up of the fire indicator lamp 16 under the control of the microcomputer 14. This sensitivity data transmitting light-emitting element 20 is disposed on a front surface of the main body 10 such that light emitted thereby is emitted in a cone shape from a ceiling constituting a surface where the fire sensor 1 is installed toward a floor surface. In other words, an angular transmission range of the sensitivity data transmitting light-emitting element 20 is a wide angle.

The data written into the EEPROM 15 will now be explained with reference to FIG. 13. Moreover, FIG. 13 shows relationships between sensitivity and A/D values in the fire sensor 1.

The sensitivity tolerance range in this fire sensor 1 is 1%/ft to 3%/ft, for example. Based on initial properties (NORMAL LEVEL), and estimating properties under conditions at the upper and lower limits, A/D values for 0%/ft under those conditions are set as D2 and D3, and D1, D2, D3, and D4 (A/D values) are preset as the disconnection determining level, the lower limit of the sensitivity tolerance range, the upper limit of the sensitivity tolerance range, and the fire determining level, respectively, and written to the EEPROM 15. Furthermore, thirty grades of levels (A/D values) obtained by dividing the sensitivity tolerance range into a total of thirty grades that are dense in an upper limit region (near D3) and a lower limit region (near D2), and sparse in a central region, for example, are written to the EEPROM 15 as levels of pulse spacing Tw for sensitivity output. By adjusting the density of this division into thirty grades, levels in portions close to abnormalities can be output in detail with a limited number of grades. Moreover, the relationship among D1, D2, D3, and D4 is D1<D2<D3<D4.

In addition, pulse spacings Tw corresponding to the above thirty grades are designated so as to correspond to respective sensitivity levels and are written to the EEPROM 15. Specifically, a pulse spacing Tw corresponding to D3 is set to 1 msec, and a pulse spacing Tw corresponding to D2 is set to 40 msec. Pulse spacings Tw obtained by dividing the interval between 1 msec and 40 msec into a total of thirty parts respectively correspond to the thirty grades of sensitivity levels described above. In addition, pulse spacings Tw1 and Tw2 representing transmission signals for abnormal sensitivity are set to 60 msec and 65 msec, for example, which are outside the range of pulse spacings from 1 msec to 40 msec corresponding to the sensitivity tolerance range, and are stored in the EEPROM 5.

Moreover, because the microcomputer 14 decides that sensitivity is abnormal if the A/D value for sensitivity is outside the range between the upper and lower limits D2 and D3, and performs flashing to indicate the abnormal state using the fire indicator lamp 16, as described below, the range for abnormalities is outside the above thirty grades, but the above thirty grades of levels may also be set so as to include the range for abnormalities.

A status information determining and outputting means 23 for determining and outputting status information corresponding to the status of the detecting portion, and a status information transmitting means 24 for setting temporal factors of pulses based on the status information, and making the sensitivity data transmitting light-emitting element 20 emit pulses based on the temporal factors thus set are stored in the MPU of the microcomputer 14. The status information determining and outputting means 23 averages six received A/D values and designates the result as the current sensitivity, determines whether the current sensitivity lies within the sensitivity tolerance range, and generates an output. The status information transmitting means 24, on the other hand, determines which grade of sensitivity level among the sensitivity levels obtained by dividing the sensitivity tolerance range into thirty grades matches the current sensitivity obtained by the status information determining and outputting means 23, sets a pulse spacing Tw between two pulses corresponding to the matching grade of sensitivity level and makes the sensitivity data transmitting light-emitting element 20 emit pulsed light. If the status information transmitting means 24 determines that the current sensitivity obtained by the status information determining and outputting means 23 is outside the sensitivity tolerance range, the status information transmitting means 24 selects a pulse spacing Tw1 (or Tw2) and makes the sensitivity data transmitting light-emitting element 20 emit pulsed light. Here, the status information is the sensitivity of the detecting portion.

Moreover, the status information determining and outputting means 23 is a sensitivity information preparing means, and also a sensitivity information determining means. The status information transmitting means 24 is a sensitivity information transmitting means. As a sensitivity information determining means, the status information determining and outputting means 23 further determines whether the current sensitivity lies within the sensitivity tolerance range. If the status information transmitting means 24 functioning as a sensitivity information transmitting means determines that the current sensitivity does not lie within the sensitivity tolerance range, the status information transmitting means 24 sets a pulse spacing Tw1 (Tw2) and makes the sensitivity data transmitting light-emitting element 20 emit pulsed light.

In other words, S22 through S24 correspond to operations of the sensitivity information preparing means. S25 through S27 and S33 through S35 correspond to operations of the sensitivity information determining means. S36 through S37 correspond to operations of the sensitivity information transmitting means.

Next, a configuration of the sensitivity tester 3 will be explained with reference to FIGS. 5 through 7.

A power and switching indicator lamp 31 is constituted by two colored (green and orange) LEDs, and indicates whether power to the sensitivity tester 3 is switched on, and also indicates the status of a switch for distinguishing between photoelectric and ionization fire sensors. If the object being measured for sensitivity is a photoelectric fire sensor, the green LED is lit, and if it is an ionization fire sensor, the orange LED is lit. Moreover, when the power is first switched on, the photoelectric mode is selected.

An error indicator lamp 32 is constituted by a red LED, and lights up if the sensitivity tester 3 is not able to receive sensitivity data from the fire sensor 1 normally. A display 33 is a 7-segmented display for displaying numerical sensitivity values, and also displays "88" if the received sensitivity data are outside the upper limit of the tolerance range, and displays "00" if less than the lower limit. Moreover, provided that it can be understood that the sensitivity data is outside the tolerance range, the display may also be other than "88" or "00".

A sensitivity data receiving light-receiving element 34 functioning as a terminal equipment signal receiving element is a photo diode for receiving infrared light emitted by the sensitivity data transmitting light-emitting element 20. An optical filter (not shown) is disposed on a front surface of the sensitivity data receiving light-receiving element 34 to cut visible light. Furthermore, the sensitivity data receiving light-receiving element 34 is disposed inside the main body 30 so as to be separated from an opening 30*a* disposed through the main body 30 to make a light-receiving angle narrow and increase directivity.

A power switch 35 is a push-button switch disposed on a surface of the main body 30, and the power is switched on or off by a long push. Mode switching between the photoelectric mode and an ionization mode is performed by normal operation of the power switch 35 (operation other than a long push) after switching on the power. A measurement start switch 36 is a push-button switch disposed on a surface of the main body 30, and reception of sensitivity data signals transmitted from the fire sensor 1 is started by operating this measurement start switch 36.

A microcomputer 37 is a circuit chip for controlling overall operation of the sensitivity tester 3, includes: a microprocessor (MPU) 38; and a storage means (memory) 39 for holding data in an interior portion, and has a plurality of ports for conducting input and output to respective portions.

Output from the sensitivity data receiving light-receiving element 34 is amplified by an amplifier 40, demodulated by a carrier wave demodulator 41, and then input to the microcomputer 37. The pulse spacing Tw of the sensitivity data input to the microcomputer 37 is measured by a pulse spacing measuring portion 42. The MPU 38 compares the measured pulse spacing Tw with data stored in the memory 39, determines the status of the sensitivity of the fire sensor 1, and outputs the determined result to a display drive portion 43 to display it on the display 33. Here, a status information acquiring means is constituted by the sensitivity data receiving light-receiving element 34, the amplifier 40, the carrier wave demodulator 41, and the microcomputer 37. Moreover, the sensitivity tester 3 is palm-sized and portable, and an electric cell 44 is mounted inside the sensitivity tester 3.

Next, operation of a fire sensor configured in this manner will be explained with reference to the flowcharts shown in FIGS. 8 through 11 and the time charts shown in FIGS. 14 through 16. Moreover, for convenience Step 1, Step 2, etc., will be indicated by S1, S2, etc., hereinafter and in the figures.

First, the operation of the microcomputer 14 for controlling the overall operation of the fire sensor 1 will be explained based on the flowchart shown in FIG. 8.

The operation starts (S1) when the power is switched on in the fire sensor 1. Initialization (S2) is performed, then a timer circuit 21 that activates the microcomputer 14 in a predetermined cycle starts to operate. The timer circuit 21 completes a cycle (TIME UP) every 3.5 seconds (S3), and outputs an activating output to the microcomputer 14. Thus, the microcomputer 14, as shown in FIG. 14A, enters a running state from a sleep state in 3.5 second cycles.

Next, when the microcomputer 14 is activated, a counter C1 is incremented by one (S4). Then, the operation determines whether the counter C1 equals 3 (S5).

At S5, if C1 does not equal 3, the operation proceeds to S6 and executes a fire determination routine, then proceeds to S9 and executes a blinking routine. At S5, if C1 equals 3, C1 is restored to 0 (S7) and the operation proceeds to S8 and executes a sensitivity measurement routine, then proceeds to S9 and executes the blinking routine. The counting operation at S4 and S5 ensures that the sensitivity measurement routine is executed instead of the fire determination routine once every three iterations.

Then, when the blinking routine at S9 is completed, the operation returns to the initial phase and waits for TIME UP (S3). At this time, the microcomputer 14 is in the sleep state. Although not shown as a step, the microcomputer 14 enters the sleep state automatically from the running state after processing the blinking routine.

Next, processing of the fire determination routine will be explained with reference to FIG. 9.

In the fire determination routine, the microcomputer 14 first activates the amplifier 13 (S11), and then makes the smoke detecting light-emitting element 11 emit light. The microcomputer 14 performs analog-to-digital conversion on the received light output from the smoke detecting light-receiving element 12 amplified by the amplifier 13 and imports it as an A/D value (S12).

Next, the microcomputer 14 compares the captured A/D value and the disconnection determining level (D1) stored in the EEPROM 15 and determines whether there is an abnormality such as disconnection of the smoke detecting light-emitting element 11 or the smoke detecting light-receiving element 12, etc., (S13). At S13, if it is determined that there has been a disconnection (captured A/D value≦D1), the operation proceeds to S14 and switches a disconnection flag F1 on. If it is determined that there has not been a disconnection (captured A/D value>D1), the operation proceeds to S15 and switches the disconnection flag F1 off.

Next, the microcomputer 14 compares the A/D value with the fire determination level (D4) that is stored in the EEPROM 15, and determines whether a fire has started (S16). At S16, if it is determined that a fire has not started (captured A/D value<D4), the operation proceeds to S9 and the blinking routine is executed. On the other hand, if it is determined at S16 that a fire has started (captured A/D value≧D4), the operation proceeds to S17 and a fire output is output to the switching circuit 18, and then the microcomputer 14 enters a stopped state.

On receiving the fire output, the switching circuit 18 switches on and holds itself to maintain a low impedance state between the terminals 19. Thus, a fire signal is output to the fire signal receiver 2 through the power and signal lines 4 connected to the terminals 19. Because the switching circuit 18 holds itself in the ON state, the fire indicator lamp 16 is maintained in a lit state, as shown in FIG. 14C, to visually warn that fire has broken out. Here, the reason that the microcomputer 14 is made to enter a stopped state after the fire output is that when the switching circuit 18 switches to the ON state, the resulting low impedance state reduces the power potential, and the fire sensor 1 can no longer operate in a normal manner.

Next, processing of the sensitivity measurement routine will be explained with reference to FIG. 10.

In the sensitivity measurement routine, the microcomputer 14 first activates the amplifier 13 (S21), and then makes the smoke detecting light-emitting element 11 emit light. The microcomputer 14 performs analog-to-digital conversion on the received light output from the smoke detecting light-receiving element 12 amplified by the amplifier 13 and imports it as an A/D value (S22). In the sensitivity measurement routine, since smoke is not present, output from the smoke detecting light-receiving element 12 is at a low level. Thus, in order to make an accurate determination based on this low level output, the gain of the amplifier 13 is set high, and the greatly amplified received light output is captured.

Next, the microcomputer 14 overwrites an A/D value stored in the memory. Specifically, a filtering process is performed in which the oldest data stored in the memory is updated with the newest data. Then, the average value of the A/D values is calculated from six data items stored in the memory (S23). This calculated average value is stored as the current sensitivity at a predetermined position in the memory (S24).

Next, the microcomputer 14 compares the average value stored in the memory and the levels of the upper limit and the lower limit of the tolerance range (D3 and D2) stored in the EEPROM 15, and determines whether the current sensitivity is within the tolerance range (S25). At S25, if it is determined that the current sensitivity is outside the tolerance range (captured A/D value<D2 or A/D value>D3), the operation proceeds to S26 and switches an abnormality flag F2 on. On the other hand, if it is determined at S25 that the current sensitivity is within the tolerance range (D2≦captured A/D value≦D3), the operation proceeds to S27 and switches the abnormality flag F2 off. Thereafter, the operation proceeds to S9 and the blinking routine is executed. Here, S23 through S27 correspond to operations of the status information determining and outputting means 23.

Moreover, age-related changes in the fire sensor 1 arise due to the sensitivity gradually changing due to contamination inside the black box, deterioration of circuit elements, etc. Since these sensitivity changes occur gradually, the influence of momentary abnormal values is eliminated in this sensitivity measurement routine by taking the average value over one minute.

Next, processing of the blinking routine will explained with reference to FIG. 11.

In the blinking routine, the microcomputer 14 first determines whether the counter C1 equals 0 (S31). At S31, if it is determined that C1 does not equal 0, the operation returns to the initial phase and waits for TIME UP (S3). If it is determined at S31 that C1 equals 0, the operation proceeds to S32 and determines whether the disconnection flag F1 is switched on.

At S32, if it is determined that the disconnection flag F1 is switched on, the operation returns to the initial phase and waits for TIME UP (S3). At this time, the microcomputer 14 keeps the blinking transistor 17 switched off. Thus, the fire indicator lamp 16 is switched off, as shown in FIG. 14D, to visually warn that a disconnection failure has occurred or the power is off. On the other hand, if it is determined at S32 that the disconnection flag F1 is switched off, the operation proceeds to S33 and determines whether the abnormality flag F2 is switched on.

At S33, if it is determined that the abnormality flag F2 is switched off, the operation proceeds to S34 and the microcomputer 14 outputs a normal pulsed light output to the blinking transistor 17. Using this pulsed light output, the blinking transistor 17 is switched on pulsatingly and the fire indicator lamp 16 performs pulsed lighting, showing visually that the fire sensor 1 is operating normally. The pulsed lighting of the fire indicator lamp 16 is performed only if the counter C1 is 0, and is a blinking operation performing pulsed lighting cyclically at a rate of once every 10.5 seconds, as shown in FIG. 14B.

At S33, if it is determined that the abnormality flag F2 is switched on, the operation proceeds to S35 and the microcomputer 14 outputs two pulsed light outputs to the blinking transistor 17, then proceeds to S36. Then, when the two pulsed light outputs are output to the blinking transistor 17, the fire indicator lamp 16 performs double blinking in which pulsed lighting is performed twice in succession with an interval of 100 msec as shown in FIG. 14E, for example, which can clearly be distinguished from normal blinking, visually warning that the fire sensor 1 has abnormal sensitivity. At S36, the current sensitivity data stored in the memory is read out, and an emitted light output corresponding to the data in question is output (S37). At this time, if the current sensitivity data is below the sensitivity tolerance range, the pulse spacing Tw1 is selected, and an emitted light output having that pulse spacing Tw1 is output. Furthermore, if the current sensitivity data is above the sensitivity tolerance range, the pulse spacing Tw2 is selected, and an emitted light output having that pulse spacing Tw2 is output. Here, S31 through S37 correspond to operations of the status information transmitting means 24.

Next, the microcomputer 14 reads out the current sensitivity data stored in the memory (S36), and outputs an emitted light output corresponding to the data in question (S37), then the operation returns to the initial phase and waits for TIME UP (S3). At S37, relative to the sensitivity tolerance range from the upper limit (D3) to the lower limit (D2) stored in the EEPROM 15, the microcomputer 14 decides which grade of the sensitivity levels between D2 and D3 the current sensitivity data belongs to. Then, if the current sensitivity data matches D3, for example, an emitted light output having a pulse spacing Tw of 1 msec is output, as shown in FIG. 16A. If the current sensitivity data matches D2, for example, an emitted light output having a pulse spacing Tw of 40 msec is output, as shown in FIG. 16B. Thus, a pulse spacing Tw corresponding to the grade of the sensitivity level to which the current sensitivity data belongs is selected from the pulse spacings Tw corresponding to the thirty grades of sensitivity levels stored in the EEPROM 15, and an emitted light output having the selected pulse spacing Tw is output.

At S37, if the current sensitivity data is below the sensitivity tolerance range, the pulse spacing Tw1 is selected, and an emitted light output having that pulse spacing Tw1 is output. Furthermore, if the current sensitivity data is above the sensitivity tolerance range, the pulse spacing Tw2 is selected, and an emitted light output having that pulse spacing Tw2 is output.

The emitted light output corresponding to this sensitivity data, as shown in FIG. 15, is modulated to a specific frequency fc, such as 38 kHz, for example, and output by the sensitivity data transmitting light-emitting element 20. Thus, the light emitted by the sensitivity data transmitting light-emitting element 20 is distinguishable from light from noise light sources such as incandescent lamps, fluorescent lights, etc.

Thus, the emitted light output corresponding to this sensitivity data is made by converting the current sensitivity into a pulse spacing Tw between two pulses, and making the sensitivity data transmitting light-emitting element 20 emit light in two pulses so as to be at the converted pulse spacing Tw. Thus, the time from the first pulse of emitted light to the next pulse of emitted light represents the current sensitivity. Transmission of this sensitivity data, as shown in FIG. 14F, is performed every 10.5 seconds with a timing identical to that of the blinking of the fire indicator lamp 16, and when blinking of the fire indicator lamp 16 is not performed, transmission of the sensitivity data is not performed, either. Moreover, in a single switching on in FIG. 14F, two pulses of light are emitted, as shown in FIG. 15, but for the purposes of timing they are shown single.

Next, operation of the sensitivity tester 3 will be explained with reference to FIG. 12 and FIG. 17. Moreover, the flowchart shown in FIG. 12 is the operation of the microcomputer 37 for controlling the overall operation of the sensitivity tester 3.

The sensitivity tester 3 is first started by switching the power on by a long push on the power switch 35 (S41). Thus, the microcomputer 37 performs an initialization (S42), then monitors for switch operation.

Then, at S43, if the power switch 35 is operated normally, mode switching is performed (S44), and photoelectric mode or ionization mode is selected depending on the fire sensor 1 to be measured for sensitivity, and the power and switching indicator lamp 31 lights up so as to correspond to the selected mode.

Next, at S45, the operation determines whether or not the measurement start switch 36 has been switched on. If it is determined that the measurement start switch 36 has been switched on, the operation proceeds to S46 and starts a timer T1, then waits for the first pulse P1 representing the sensitivity data (S47). At this time, the timer T1 is set to 30 seconds, for example, and the operation waits for the first pulse P1 until the timer T1 completes a cycle (T1 TIME UP) (S48). Then, if the timer T1 completes a cycle, an error is returned, and the operation proceeds to S62 and displays the error by lighting up the error indicator lamp 32.

If the first pulse P1 is received at S47, a counter is started (S49), and the timer T1 is cleared (S50). Next, a timer T2 is started (S51), and the operation waits for the second pulse P2 representing the sensitivity data (S52). At this time, the timer T2 is set to 0.5 second, for example, and the operation waits for the second pulse P2 until the timer T2 completes a cycle (T2 TIME UP) (S53). Then, if the timer T2 completes a cycle, an error is returned, and the operation proceeds to S62 and displays the error by lighting up the error indicator lamp 32.

If the second pulse P2 is received at S52, the counter is stopped (S54), and the timer T2 is cleared (S55). Next, a timer T3 is started (S56), and the operation waits for a third pulse (S57). At this time, the timer T3 is set to 3.0 seconds, for example. Then, if a third pulse is received before the timer T3 completes a cycle (T3 TIME UP), a noise error is returned, the timer T3 is cleared (S58) and the operation proceeds to S62 and displays the error by lighting up the error indicator lamp 32. In other words, unnecessary pulses are detected, as shown in FIG. 17B, and the third pulse is recognized as a noise pulse Pn and displayed as an error.

Furthermore, if the timer T3 completes a cycle (T3 TIME UP) (S59) without a third pulse being received, as shown in FIG. 17A, the operation proceeds to S60. Then, the microcomputer 37 calculates the current sensitivity from the count value of the counter from start to stop and displays a numerical value for the current sensitivity (in %/ft) on the display 33 (S61). If the current sensitivity calculated from the count value is less than the sensitivity tolerance range, "00" is displayed on the display 33, and if greater, "88" is displayed on the display 33. Thus, a checker can recognize any abnormality in the sensitivity. At this time, the microcomputer 37 holds the acquired current sensitivity in the memory 39, and keeps it displayed on the display 33.

Thus, the sensitivity tester 3 performs a signal receiving operation for the sensitivity data from the fire sensor 1 based on the operation of the measurement start switch 36, and displays the received current sensitivity on the display 33 (S61), or displays an error on the error indicator lamp 32 (S62). Thereafter, the microcomputer 37 returns to monitoring for a switch operation after performing an initialization. The operation described above is repeated every time the measurement start switch 36 is operated. Moreover, when the measurement start switch 36 is operated, the contents of the display 33 or the error indicator lamp 32 are cleared, and the current sensitivity stored in the memory 39 is also cleared.

If the timers T1 or T2 complete a cycle (S48 or S53), or if a third pulse is received before the timer T3 completes a cycle (S57), it is assumed that the two pulses P1 and P2 representing the sensitivity data were not received properly, and the microcomputer 37 performs an error display by lighting up the error indicator lamp 32. Thus, the checker will execute the sensitivity measurement again by operating the measurement start switch 36.

Infrared light may also be emitted as illumination from lighting equipment installed in the vicinity of the fire sensor 1. If the infrared light from this lighting equipment is received by the sensitivity tester 3, a third pulse, in other words, noise, will be received before the timer T3 completes a cycle. In that case, the error indicator lamp 32 lights up, and the checker can recognize the error visually. Then, the checker can execute the sensitivity measurement again by bringing the sensitivity tester 3 closer to the fire sensor 1, enabling noise to be reliably removed.

In this manner, according to Embodiment 1, a decision is made as to which grade of sensitivity level within the sensitivity tolerance range the current sensitivity is in, a pulse spacing Tw is set to match the grade of sensitivity level the current sensitivity is in, and the sensitivity data transmitting light-emitting element 20 is made to emit two pulses within a predetermined timing at the set pulse spacing Tw. Thus, a fire sensor and a fire sensor status information acquisition system having low power consumption can be achieved in which the number of times light is emitted from the sensitivity data transmitting light-emitting element 20 is greatly reduced compared to conventional devices in which the sensitivity data is transmitted by making a light-emitting element emit light based on transmitted data in which the sensitivity data is encoded.

Because thirty grades of sensitivity levels are obtained by dividing an upper limit region and a lower limit region of the sensitivity tolerance range densely, and dividing a central region of the sensitivity tolerance range sparsely, resolution in the upper limit region and the lower limit region of the sensitivity tolerance range is high, enabling the current sensitivity to be detected with high precision if the upper limit region or the lower limit region of the sensitivity tolerance range is reached. Thus, the detecting portion of the fire sensor 1 can be changed before the current sensitivity is outside the sensitivity tolerance range, enabling stable fire detection to be achieved.

Because the fire indicator lamp 16 is blinked in synchrony with the pulses transmitting the sensitivity data from the sensitivity data transmitting light-emitting element 20, the checker can check visually that the sensitivity data is being transmitted from the fire sensor 1, facilitating sensitivity data inspection work.

Because the sensitivity tester 3 displays an error on the error indicator lamp 32 if three or more pulses are received within a predetermined timing, or if a pulse is received outside the predetermined timing, false detection of sensitivity data due to noise can be checked visually. Thus, if an error is displayed by the error indicator lamp 32, accurate sensitivity data can be obtained with the influence of noise removed by performing the measurement again.

The angular transmission range of the sensitivity data transmitting light-emitting element 20 is set to a wide-angled range, and the angular reception range of the sensitivity data receiving light-receiving element 34 is set to a narrow-angled range. Thus, the working position of the sensitivity tester 3 is not limited, and reliable reception of signals can be performed without picking up noise components by directing a receive direction of the sensitivity tester 3 toward the fire sensor 1.

A determination is made as to whether or not the current sensitivity is within the sensitivity tolerance range, and if determined to be outside the sensitivity tolerance range (abnormal sensitivity), two light pulses are emitted from the sensitivity data transmitting light-emitting element 20 with a pulse spacing Tw1 or Tw2, and the fire indicator lamp 16 is also double-blinked. Thus, because the checker can recognize the abnormal sensitivity from a display of "00" or "88" on the display 33 of the sensitivity tester 3, and can also recognize the abnormal sensitivity from the double blinking of the fire indicator lamp 16, it is possible to decide accurately if abnormal sensitivity has actually occurred.

Because sensitivity information lying within the sensitivity tolerance range and abnormality information not lying within the sensitivity tolerance range is transmitted using a single sensitivity data transmitting light-emitting element 20, the number of parts is reduced, enabling reductions in the cost and size of the fire sensor 1.

Moreover, double blinking of the fire indicator lamp 16 is used to warn that there is abnormal sensitivity, but the warning that there is abnormal sensitivity is not limited to double blinking of the fire indicator lamp 16, and provided that the transmission of normal sensitivity information and the transmission of abnormal sensitivity can be distinguished, the number of blinks need only be different for the two.

A buzzer functioning as a sound element can also be disposed on the fire sensor 1 instead of the fire indicator lamp 16 for the warning means. Then, the buzzer can be sounded momentarily just at the time of abnormal sensitivity instead of the double blinking of the fire indicator lamp 16.

Embodiment 2

Figure 18:
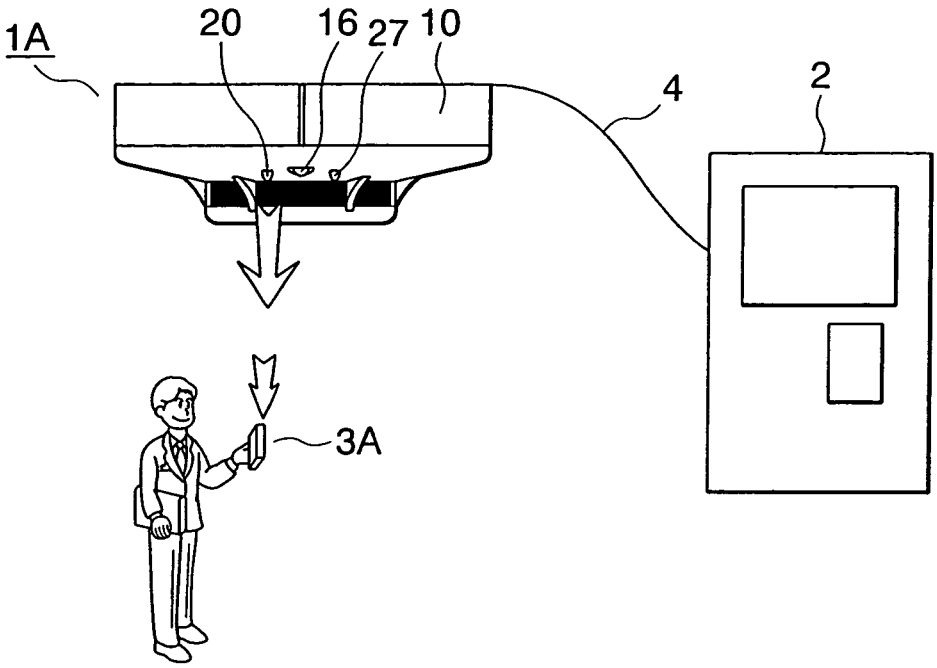
FIG. 18 is a system diagram schematically showing a fire sensor status information acquisition system according to Embodiment 2 of the present invention.
Figure 19:
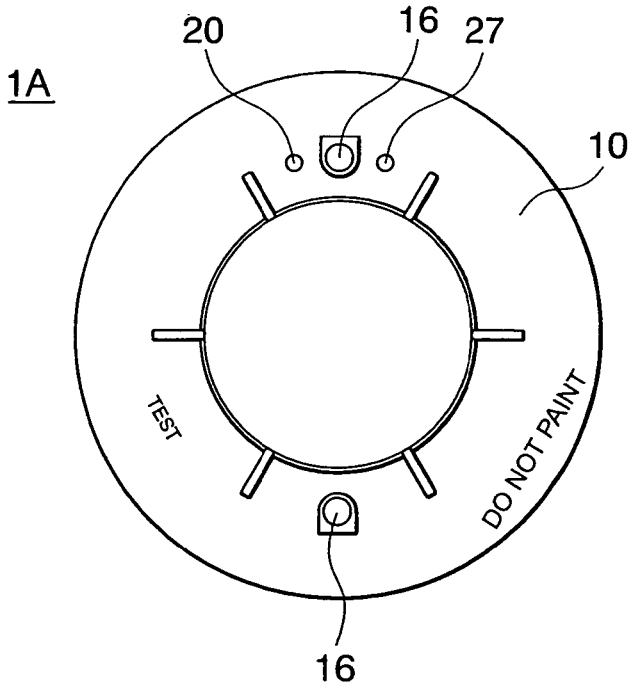
FIG. 19 is a front elevation showing a fire sensor according to Embodiment 2 of the present invention.
Figure 20:
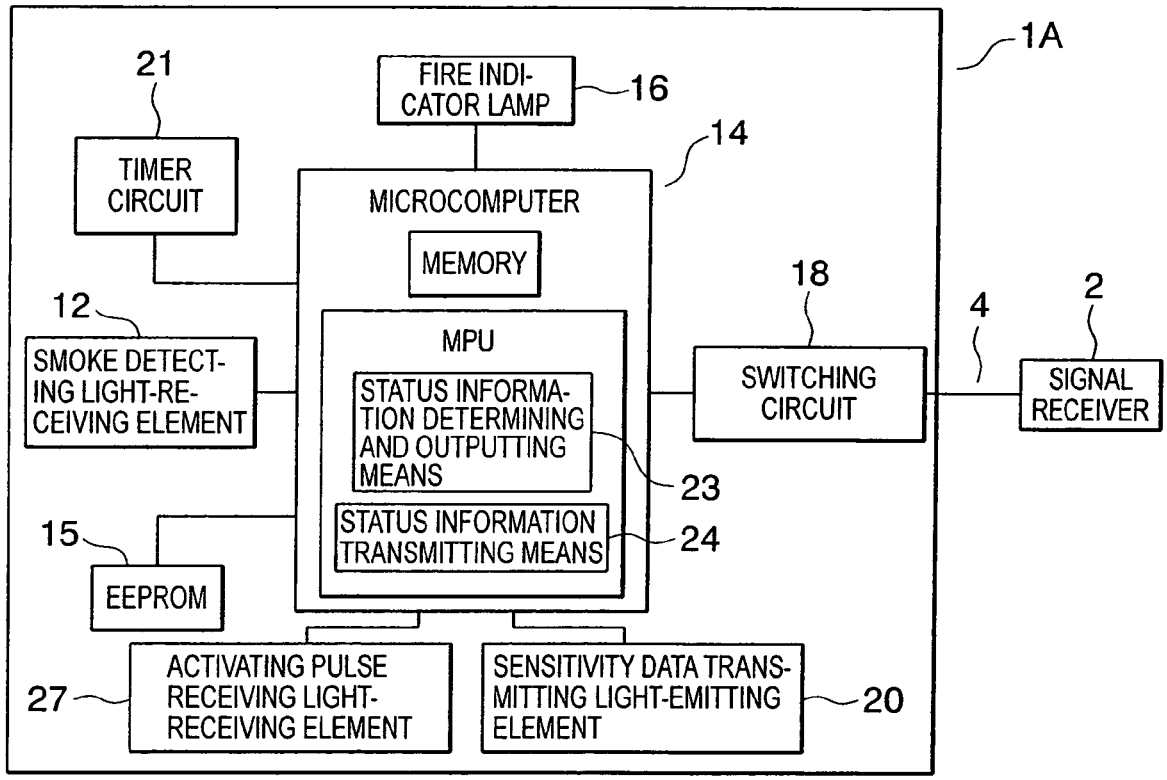
FIG. 20 is a block diagram schematically showing a configuration of the fire sensor according to Embodiment 2 of the present invention.
Figure 21:
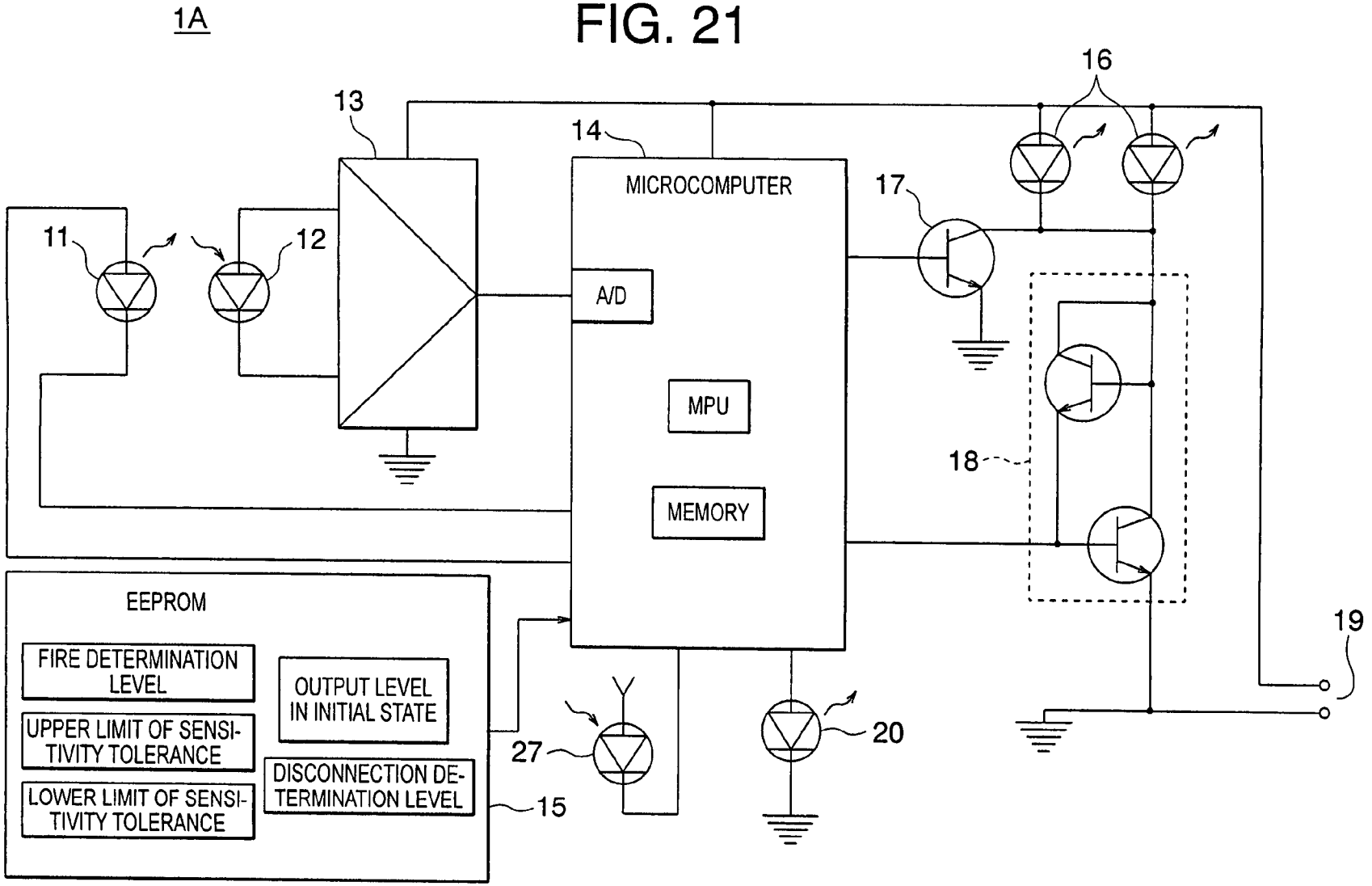
FIG. 21 is a block circuit diagram schematically showing a circuit configuration of the fire sensor according to Embodiment 2 of the present invention.
Figure 22:
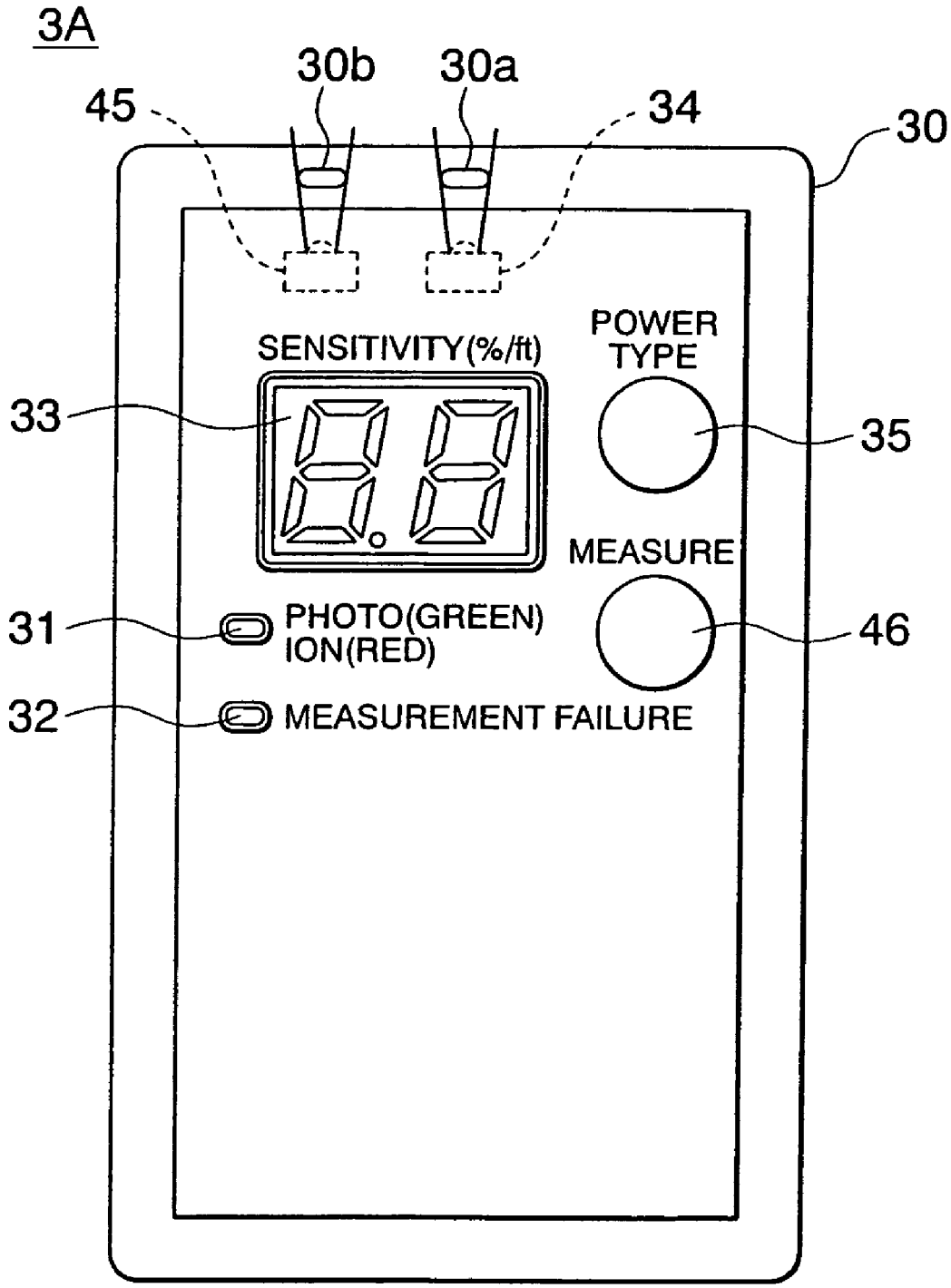
FIG. 22 is a front elevation showing a sensitivity tester according to Embodiment 2 of the present invention.
Figure 23:
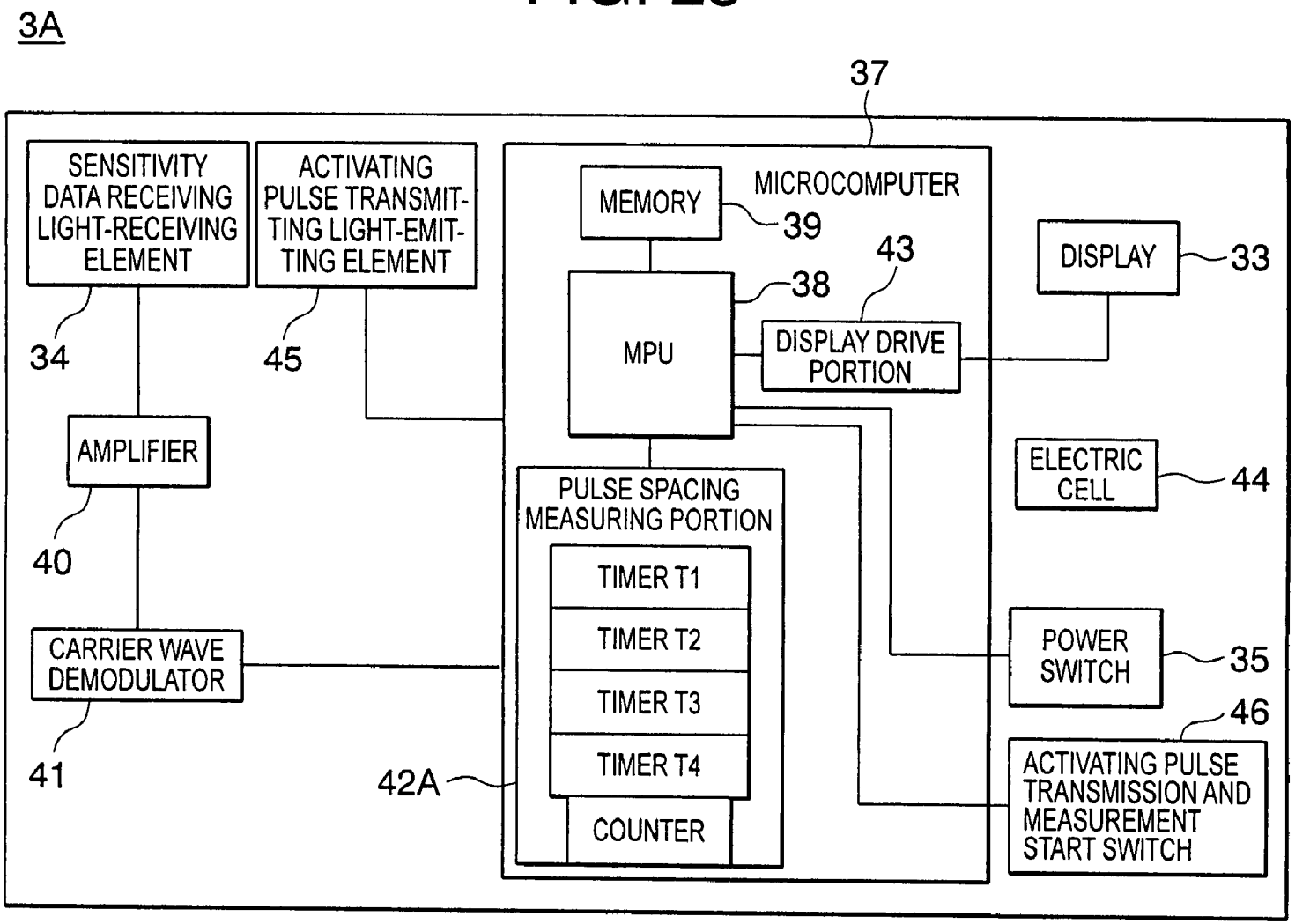
FIG. 23 is a block diagram schematically showing a configuration of the sensitivity tester according to Embodiment 2 of the present invention.
Figure 24:
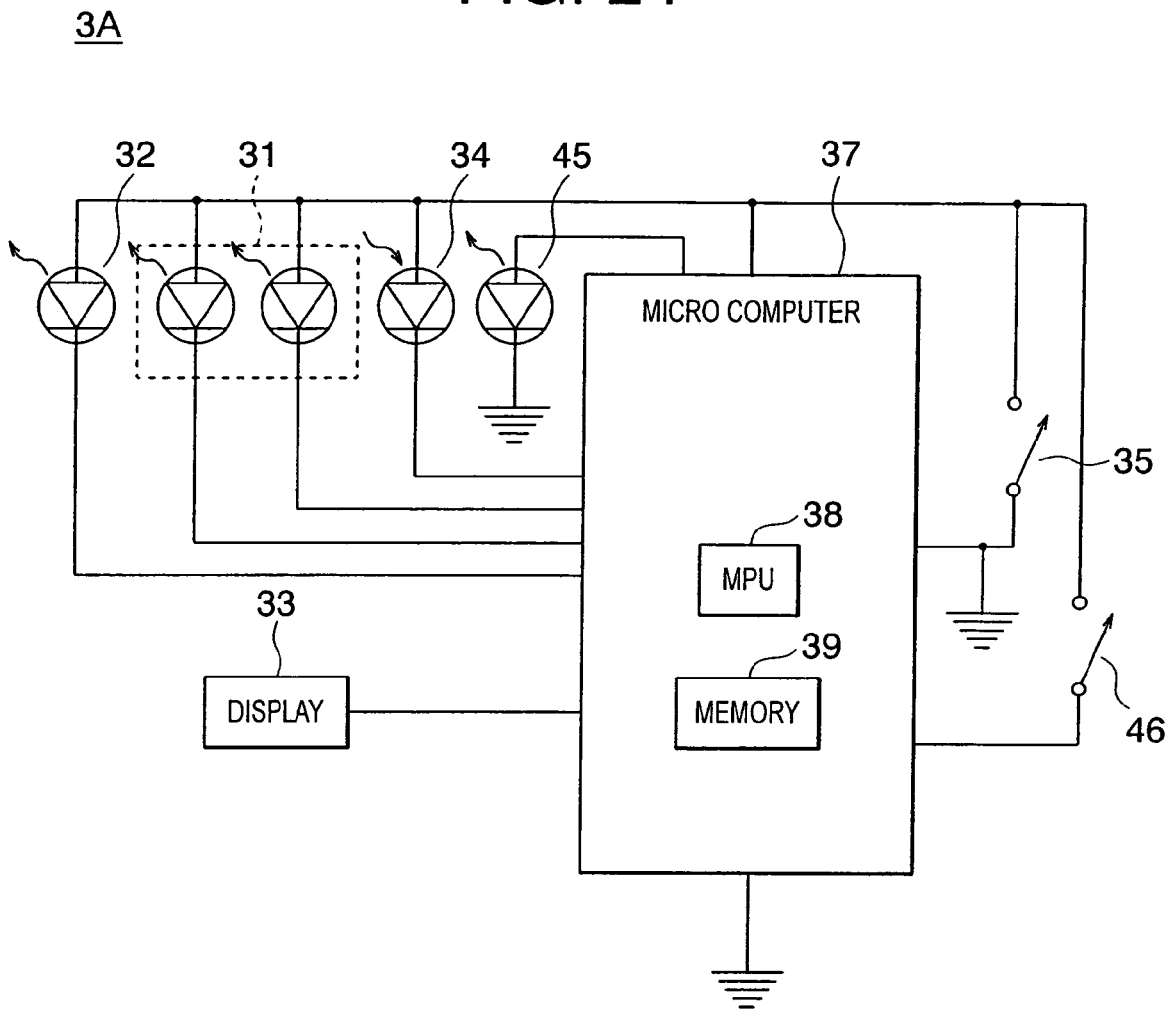
FIG. 24 is a block circuit diagram schematically showing a circuit configuration of the sensitivity tester according to Embodiment 2 of the present invention.
Figure 25:
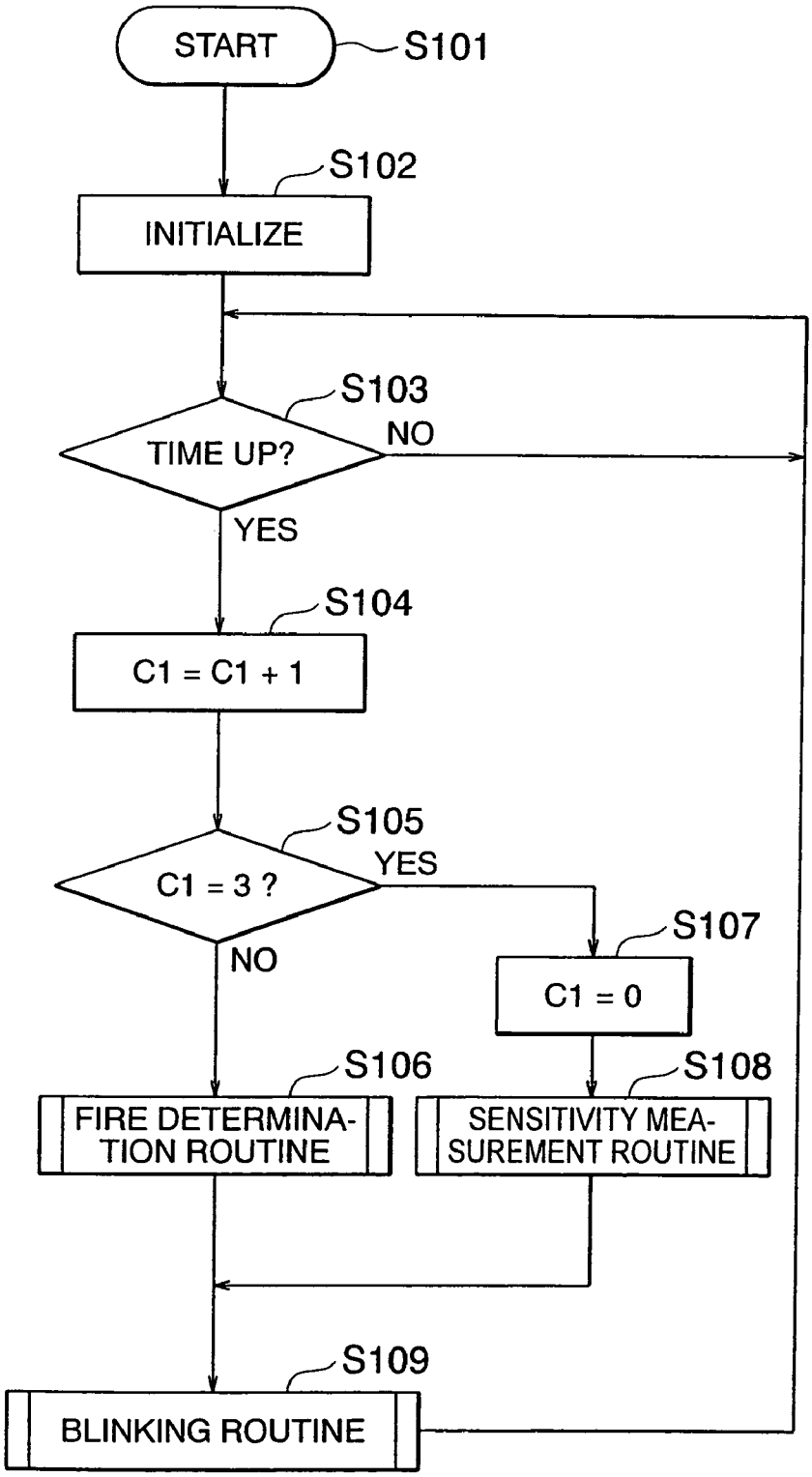
FIG. 25 is a flow chart explaining overall operation of the fire sensor according to Embodiment 2 of the present invention.
Figure 26:
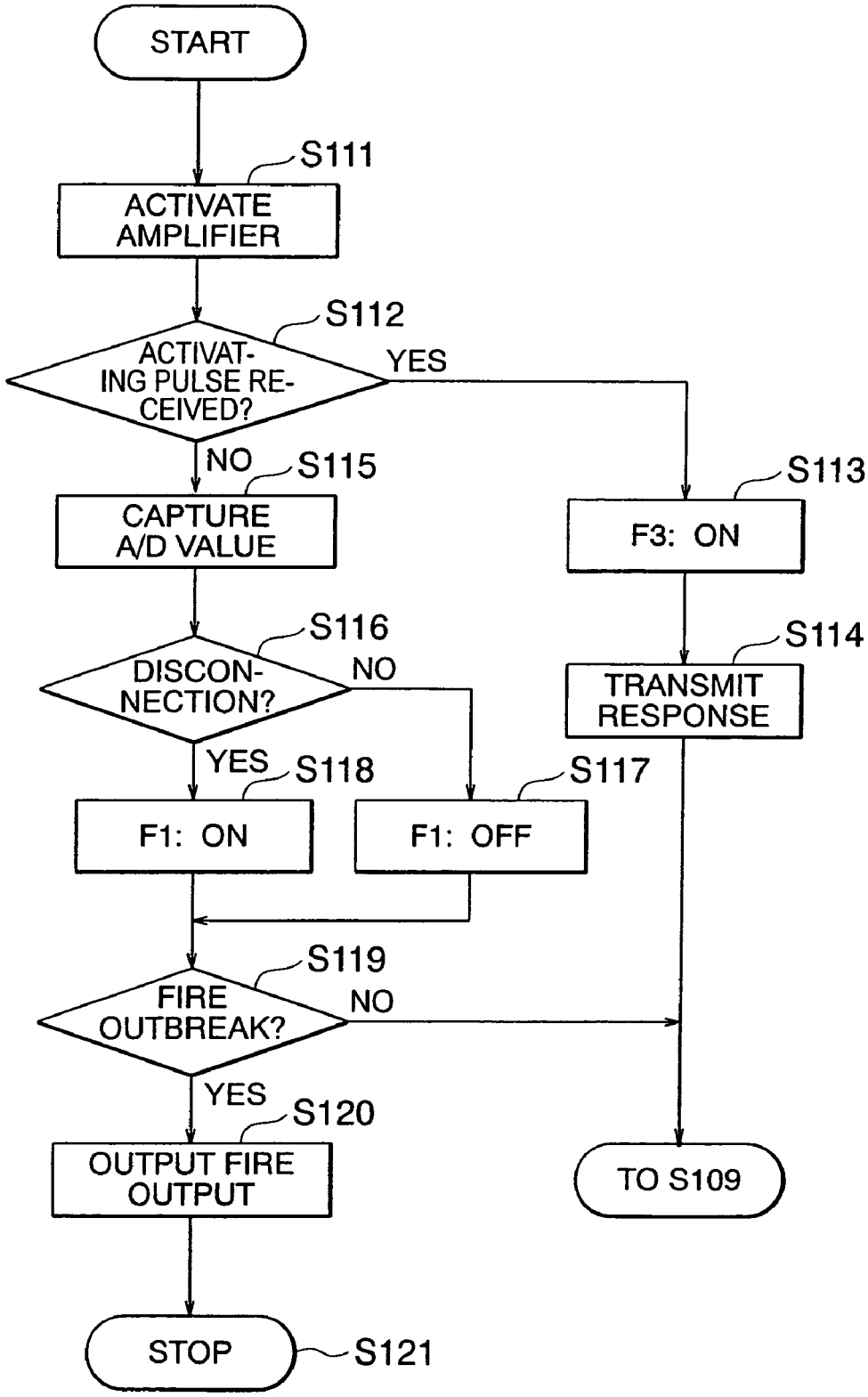
FIG. 26 is a flow chart explaining a fire determining operation in the fire sensor according to Embodiment 2 of the present invention.
Figure 27:
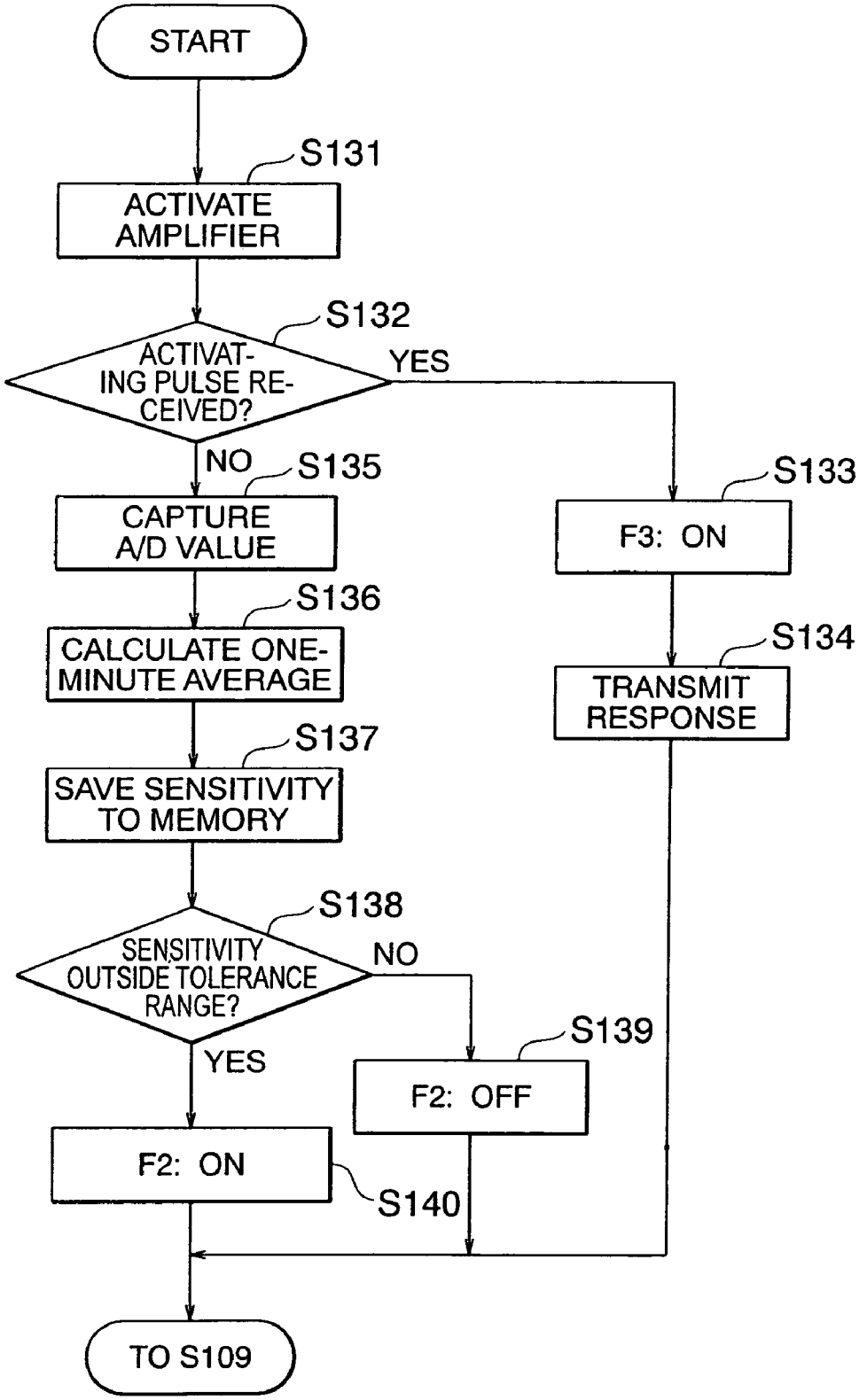
FIG. 27 is a flow chart explaining a sensitivity measuring operation in the fire sensor according to Embodiment 2 of the present invention.
Figure 28:
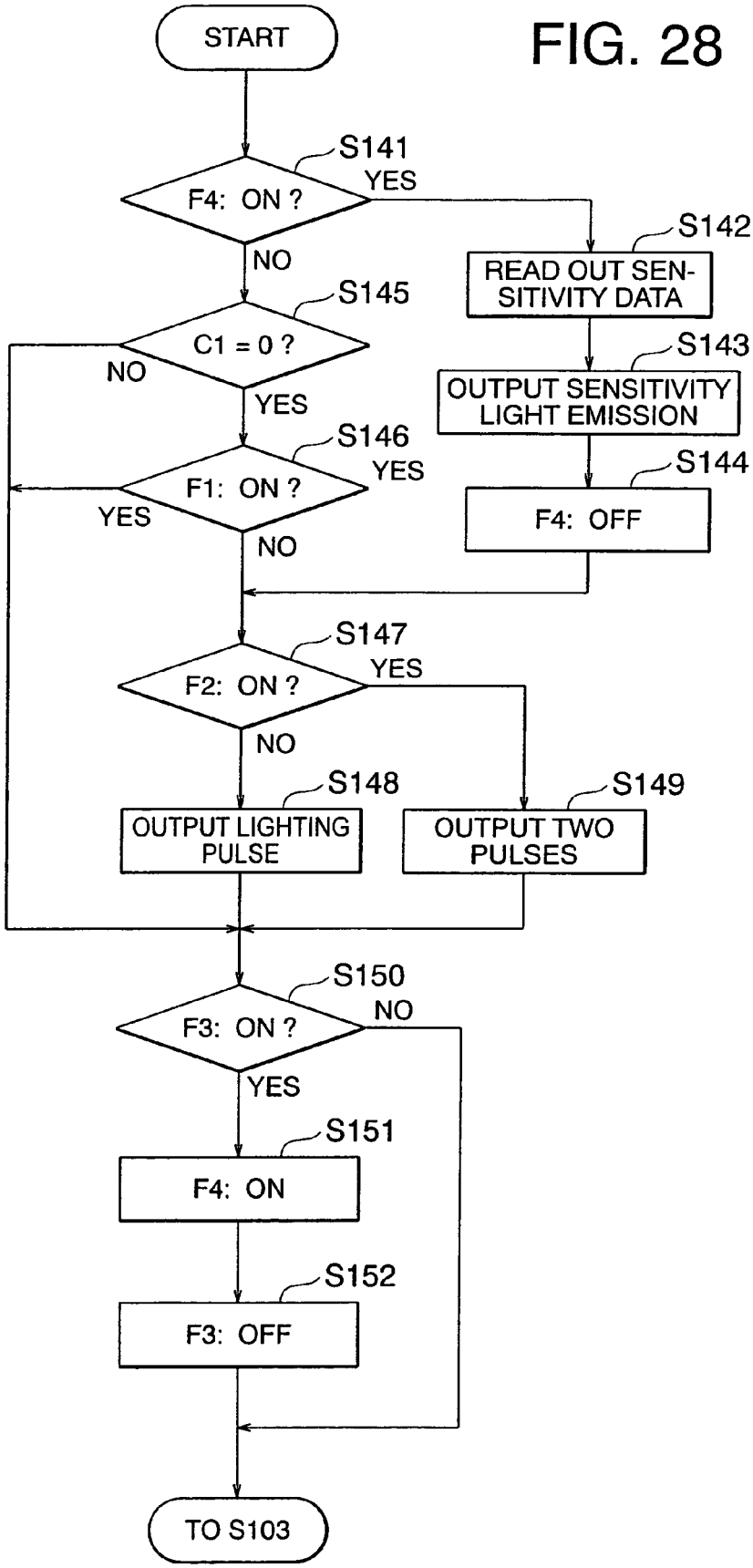
FIG. 28 is a flow chart explaining a blinking operation in the fire sensor according to Embodiment 2 of the present invention.

FIG. 18 is a system diagram schematically showing a fire sensor status information acquisition system according to Embodiment 2 of the present invention, FIG. 19 is a front elevation showing a fire sensor according to Embodiment 2 of the present invention, FIG. 20 is a block diagram schematically showing a configuration of the fire sensor according to Embodiment 2 of the present invention, FIG. 21 is a block circuit diagram schematically showing a circuit configuration of the fire sensor according to Embodiment 2 of the present invention, FIG. 22 is a front elevation showing a sensitivity tester according to Embodiment 2 of the present invention, FIG. 23 is a block diagram schematically showing a configuration of the sensitivity tester according to Embodiment 2 of the present invention, and FIG. 24 is a block circuit diagram schematically showing a circuit configuration of the sensitivity tester according to Embodiment 2 of the present invention. FIG. 25 is a flow chart explaining overall operation of the fire sensor according to Embodiment 2 of the present invention, FIG. 26 is a flow chart explaining a fire determining operation in the fire sensor according to Embodiment 2 of the present invention, FIG. 27 is a flow chart explaining a sensitivity measuring operation in the fire sensor according to Embodiment 2 of the present invention, FIG. 28 is a flow chart explaining a blinking operation in the fire sensor according to Embodiment 2 of the present invention, and FIG. 29 is a flow chart explaining operation of the sensitivity tester according to Embodiment 2 of the present invention. FIGS. 30A through 30F are timing charts explaining operation of a fire indicator lamp and a sensitivity data transmitting light-emitting element in the fire sensor according to Embodiment 2 of the present invention.

In FIG. 18, a fire sensor status information acquisition system is constituted by: a fire sensor 1A mounted to a ceiling, for example, for sensing a fire; a fire signal receiver 2 connected to the fire sensor 1A by a power and signal line 4, the fire signal receiver 2 supplying electric power to the fire sensor 1A and receiving a fire signal from the fire sensor 1A; and a sensitivity tester 3A functioning as a signal receiving apparatus and terminal equipment for receiving and displaying a status signal from the fire sensor 1A when a checker checks the status of a detecting portion of the fire sensor 1A. Moreover, a status signal is an information signal, a case is shown in which sensitivity data functioning as sensitivity information among status information is used as the status signal.

In FIGS. 19 through 21, an activating pulse receiving light-receiving element 27 functioning as a sensor signal receiving element a photo diode for receiving an activating pulse of light sent from the sensitivity tester 3A. An optical filter (not shown) is disposed on a front surface of the activating pulse receiving light-receiving element 27 to cut visible light. In addition, an angular reception range of the activating pulse receiving light-receiving element 27 is a wide angle in a similar manner to a sensitivity data transmitting light-emitting element 20 functioning as a sensor signal transmitting element. A microcomputer 14 cyclically checks for receipt of the activating pulse by the activating pulse receiving light-receiving element 27, and if the activating pulse is received, transmits a response pulse P0 instead of sensitivity data (P1+P2) from the sensitivity data transmitting light-emitting element 20, then executes a status information determining and outputting means 23 and a status information transmitting means 24, etc. In other words, this activating pulse acts as a trigger signal for performing transmission of the response pulse P0 and execution of the status information determining and outputting means 23 and the status information transmitting means 24, etc., in the microcomputer 14.

Moreover, the rest of the fire sensor 1A is configured in a similar manner to the fire sensor 1 according to Embodiment 1.

In the MPU of the microcomputer 14 in the fire sensor 1A, a sensitivity information preparing means for preparing sensitivity information corresponding to the status of a detecting portion, and a sensitivity information determining means for determining whether or not the sensitivity information is in an abnormal state, and if it is determined that the sensitivity information is in an abnormal state, making the fire indicator lamp 16 emit warning that the sensitivity information is in an abnormal state correspond to the status information determining and outputting means 23, and a sensitivity information transmitting means for transmitting the sensitivity information prepared by the sensitivity information preparing means if the sensitivity information determining means determines that the sensitivity information is in a normal state, and transmitting abnormality information instead of the sensitivity information if the sensitivity information determining means determines that the sensitivity information is in an abnormal state corresponds to the status information transmitting means 24.

Consequently, the microcomputer 14 cyclically checks for receipt of the activating pulse by the activating pulse receiving light-receiving element 27, and if the activating pulse is received, transmits the response pulse P0 instead of the sensitivity data (P1+P2) from the sensitivity data transmitting light-emitting element 20, then executes the sensitivity information preparing means, the sensitivity information determining means, and the sensitivity information transmitting means, etc. The fire indicator lamp 16 functions as a warning means.

Here, the status information determining and outputting means 23 functioning as a sensitivity information preparing means averages six captured A/D values and outputs the result as a current sensitivity, and determines whether the captured A/D values lie within the sensitivity tolerance range. In addition, the status information transmitting means 24 functioning as a sensitivity information transmitting means determines which grade of sensitivity level among the sensitivity levels obtained by dividing the sensitivity tolerance range into thirty grades matches the current sensitivity, sets a pulse spacing Tw between two pulses corresponding to the matching grade of sensitivity level and makes the sensitivity data transmitting light-emitting element 20 emit pulsed light. If the status information transmitting means 24 determines that the current sensitivity does not lie within the sensitivity tolerance range, the status information transmitting means 24 sets a pulse spacing Tw1 (or Tw2) and makes the sensitivity data transmitting light-emitting element 20 emit pulsed light.

In other words, S135 through S137 correspond to operations of the sensitivity information preparing means. S138 through S140 and S147 through S149 correspond to operations of the sensitivity information determining means. S142 through S143 correspond to operations of the sensitivity information transmitting means.

The MPU of the microcomputer 14 in the fire sensor 1A is a controlling means for checking cyclically whether or not the trigger signal has been received at the sensor signal receiving element and executing operations relating to information acquisition if the trigger signal is received.

In FIGS. 22 through 24, an activating pulse transmitting light-emitting element 45 functioning as a terminal equipment signal transmitting element is an infrared LED for transmitting an activating pulse toward the fire sensor 1A. This activating pulse transmitting light-emitting element 45 emits and transmits the activating pulse under control from the microcomputer 37. Furthermore, the activating pulse transmitting light-emitting element 45 is disposed within the main body 30 in a similar manner to the sensitivity data receiving light-receiving element 34 functioning as a terminal equipment signal receiving element so as to be separated from an opening 30*b* disposed through the main body 30 to make an angular transmitting range narrow and increase directivity.

An activating pulse transmission and measurement start switch 46 is a push-button switch disposed on a surface of the main body 30, an activating pulse being transmitted to the fire sensor 1A and reception of sensitivity data signals sent from the fire sensor 1A being started by operating this activating pulse transmission and measurement start switch 46.

A microcomputer 37 is a circuit chip for controlling overall operation of the sensitivity tester 3A, includes: a microprocessor (MPU) 38; and a storage means (memory) 39 for holding data in an interior portion, and has a plurality of ports for conducting input and output to respective portions.

When the activating pulse transmission and measurement start switch 46 is operated, the microcomputer 37 makes an activating pulse emit from the activating pulse transmitting light-emitting element 45 to transmit the activating pulse to the fire sensor 1A. The microcomputer 37 also receives a transmitted signal from the fire sensor 1A, then stops transmission of the activating pulse to the fire sensor 1A and starts reception of the sensitivity data signals transmitted from the fire sensor 1A.

Output from the sensitivity data receiving light-receiving element 34 is amplified by an amplifier 40, demodulated by a carrier wave demodulator 41, and then input to the microcomputer 37. The pulse spacing Tw of the sensitivity data input to the microcomputer 37 is measured by a pulse spacing measuring portion 42A. The MPU 38 compares the measured pulse spacing Tw with data stored in the memory 39, determines the status of the sensitivity of the fire sensor 1A, and outputs the determined result to a display drive portion 43 to display it on the display 33. The sensitivity tester 3A is palm-sized and portable, and an electric cell 44 is mounted inside the sensitivity tester 3A.

Moreover, the rest of the sensitivity tester 3A is configured in a similar manner to the sensitivity tester 3 according to Embodiment 1 above.

Next, operation of a fire sensor 1A configured in this manner will be explained with reference to the flowcharts shown in FIGS. 25 through 28 and the time charts shown in FIGS. 30, 15, and 16. Moreover, for convenience Step 101, Step 102, etc., will be indicated by S101, S102, etc., hereinafter and in the figures.

First, the operation of the microcomputer 14 for controlling the overall operation of the fire sensor 1A will be explained based on the flowchart shown in FIG. 25.

The operation starts (S101) when the power is switched on in the fire sensor 1A. Initialization (S102) is performed, then a timer circuit 21 that activates the microcomputer 14 in a predetermined cycle starts to operate. The timer circuit 21 completes a cycle (TIME UP) every 3.5 seconds (S103), and outputs an activating output to the microcomputer 14. Thus, the microcomputer 14, as shown in FIG. 28A, enters a running state from a sleep state in 3.5 second cycles.

Next, when the microcomputer 14 is activated, a counter C1 is incremented by one (S104). Then, the operation determines whether the counter C1 equals 3 (S105).

At S105, if C1 does not equal 3, the operation proceeds to S106 and executes a fire determination routine, then proceeds to S109 and executes a blinking routine. At S105, if C1 equals 3, C1 is restored to 0 (S107) and the operation proceeds to S108 and executes a sensitivity measurement routine, then proceeds to S109 and executes the blinking routine. The counting operation at S104 and S105 ensures that the sensitivity measurement routine is executed instead of the fire determination routine once every three iterations.

Then, when the blinking routine at S109 is completed, the operation returns to the initial phase and waits for TIME UP (S103). At this time, the microcomputer 14 is in the sleep state. Although not shown as a step, the microcomputer 14 enters the sleep state automatically from the running state after processing the blinking routine.

Next, processing of the fire determination routine will explained with reference to FIG. 26.

In the fire determination routine, the microcomputer 14 first activates the amplifier 13 (S111), and then makes the smoke detecting light-emitting element 11 emit light. During activation of the amplifier 13, because the amplifier 13 has a rise time, the operation determines whether or not the activating pulse receiving light-receiving element 27 has received the activating pulse in synchrony with that (S112). At S112, if it is determined that the activating pulse receiving light-receiving element 27 has received the activating pulse, the operation proceeds to S113 and switches an activation flag F3 on. Next, the operation proceeds to S114 and transmits the response pulse P0 from the sensitivity data transmitting light-emitting element 20, then proceeds to S109 without capturing the received light output and executes the blinking routine.

Here, the reason that the operation proceeds to S109 immediately after S114 is that it is conceivable that A/D value capture may be subjected to the influence of slight line voltage fluctuations due to emission of the response pulse P0 and accurate A/D value capture cannot be ensured.

At S112, if it is determined that the activating pulse receiving light-receiving element 27 has not received the activating pulse, the operation proceeds to S115. At S115, the microcomputer 14 makes the smoke detecting light-emitting element 11 emit light and performs analog-to-digital conversion on the received light output from the smoke detecting light-receiving element 12 amplified by the amplifier 13.

Next, the microcomputer 14 compares the captured A/D value and the disconnection determining level (D1) stored in the EEPROM 15 and determines whether there is an abnormality such as disconnection of the smoke detecting light-emitting element 11 or the smoke detecting light-receiving element 12, etc., (S116). At S116, if it is determined that there has been a disconnection (captured A/D value≦D1), the operation proceeds to S118 and switches a disconnection flag F1 on. If it is determined that there has not been a disconnection (captured A/D value>D1), the operation proceeds to S117 and switches the disconnection flag F1 off.

Next, the microcomputer 14 compares the A/D value with the fire determination level (D4) that is stored in the EEPROM 15, and determines whether a fire has started (S119). At S119, if it is determined that a fire has not started (captured A/D value<D4), the operation proceeds to S109 and the blinking routine is executed. On the other hand, if it is determined at S119 that a fire has started (captured A/D value≧D4), the operation proceeds to S120 and a fire output is output to the switching circuit 18, and then proceeds to S121 and the microcomputer 14 enters a stopped state.

On receiving the fire output, the switching circuit 18 switches on and holds itself to maintain a low impedance state between the terminals 19. Thus, a fire signal is output to the fire signal receiver 2 through the power and signal lines 4 connected to the terminals 19. Because the switching circuit 18 holds itself in the ON state, the fire indicator lamp 16 is maintained in a lit state, as shown in FIG. 28C, to visually warn that a fire has broken out. Here, the reason that the microcomputer 14 is made to enter a stopped state after the fire output, is that when the switching circuit 18 switches to the ON state, the resulting low impedance state reduces the power potential, and the fire sensor 1A can no longer operate in a normal manner.

Next, processing of the sensitivity measurement routine will explained with reference to FIG. 27.

In the sensitivity measurement routine, the microcomputer 14 first activates the amplifier 13 (S131). During activation of the amplifier 13, because the amplifier 13 has a rise time, the operation determines whether or not the activating pulse receiving light-receiving element 27 has received the activating pulse in synchrony with that (S132). At S132, if it is determined that the activating pulse receiving light-receiving element 27 has received the activating pulse, the operation proceeds to S133 and switches an activation flag F3 on. Next, the operation proceeds to S134 and transmits the response pulse P0 from the sensitivity data transmitting light-emitting element 20, then proceeds to S109 without capturing the received light output and executes the blinking routine.

At S132, if it is determined that the activating pulse receiving light-receiving element 27 has not received the activating pulse, the operation proceeds to S135. At S135, the microcomputer 14 makes the smoke detecting light-emitting element 11 emit light and performs analog-to-digital conversion on the received light output from the smoke detecting light-receiving element 12 amplified by the amplifier 13. In the sensitivity measurement routine, since smoke is not present, output from the smoke detecting light-receiving element 12 is at a low level. Thus, in order to make an accurate determination based on this low level output, the gain of the amplifier 13 is set high, and the greatly amplified received light output is captured.

Next, the microcomputer 14 overwrites an A/D value stored in the memory. Specifically, a filtering process is performed in which the oldest data stored in the memory is updated with the newest data. Then, the average value of the A/D values is calculated from six data items stored in the memory (S136). This calculated average value is stored as the current sensitivity at a predetermined position in the memory (S137).

Next, the microcomputer 14 compares the average value stored in the memory and the levels of the upper limit and the lower limit of the tolerance range (D3 and D2) stored in the EEPROM 15, and determines whether the current sensitivity is within the tolerance range (S138). At S138, if it is determined that the current sensitivity is outside the tolerance range (captured A/D value<D2 or A/D value>D3), the operation proceeds to S140 and switches an abnormality flag F2 on. On the other hand, if it is determined at S138 that the current sensitivity is within the tolerance range (D2≦captured A/D value≦D3), the operation proceeds to S139 and switches the abnormality flag F2 off. Thereafter, the operation proceeds to S109 and the blinking routine is executed.

Moreover, age-related changes in the fire sensor 1A arise due to the sensitivity gradually changing due to contamination inside the black box, deterioration of circuit elements, etc. Since these sensitivity changes occur gradually, the influence of momentary abnormal values is eliminated in this sensitivity measurement routine by taking the average value over one minute.

Next, processing of the blinking routine will explained with reference to FIG. 28.

In the blinking routine, the microcomputer 14 first determines whether or not a transmission flag is switched on (S141). Then, at S141, if it is determined that the transmission flag F4 is switched on, the microcomputer 14 reads out the current sensitivity data stored in the memory (S142), outputs an emitted light output corresponding to the data in question (S143), switches the transmission flag F4 off (S144), and proceeds to S147.

At S143, relative to the sensitivity tolerance range from the upper limit (D3) to the lower limit (D2) stored in the EEPROM 15, the microcomputer 14 decides which grade of the sensitivity levels between D2 and D3 the current sensitivity data belongs to. Then, if the current sensitivity data matches D3, for example, an emitted light output having a pulse spacing Tw of 1 msec is output, as shown in FIG. 16A. If the current sensitivity data matches D2, for example, an emitted light output having a pulse spacing Tw of 40 msec is output, as shown in FIG. 16B. Thus, a pulse spacing Tw corresponding to the grade of the sensitivity level to which the current sensitivity data belongs is selected from the pulse spacings Tw corresponding to the thirty grades of sensitivity levels stored in the EEPROM 15, and an emitted light output having the selected pulse spacing Tw is output.

At S143, if the current sensitivity data is below the sensitivity tolerance range, the pulse spacing Tw1 is selected, and an emitted light output having that pulse spacing Tw1 is output. Furthermore, if the current sensitivity data is above the sensitivity tolerance range, the pulse spacing Tw2 is selected, and an emitted light output having that pulse spacing Tw2 is output.

The emitted light output corresponding to this sensitivity data, as shown in FIG. 15, is modulated to a specific frequency fc, such as 38 kHz, for example, and output by the sensitivity data transmitting light-emitting element 20. Thus, the light emitted by the sensitivity data transmitting light-emitting element 20 is distinguishable from light from noise light sources such as incandescent lamps, fluorescent lights, etc.

At S141, if it is determined that the transmission flag F4 is switched off, the operation proceeds to S145 and determines whether the counter C1 is 0. At S145, if it is determined that C1 does not equal 0, the operation proceeds to S150. If it is determined at S145 that C1 equals 0, the operation proceeds to S146 and determines whether the disconnection flag F1 is switched on.

Figures 30A, 30B, 30C, 30D, 30E, 30F:
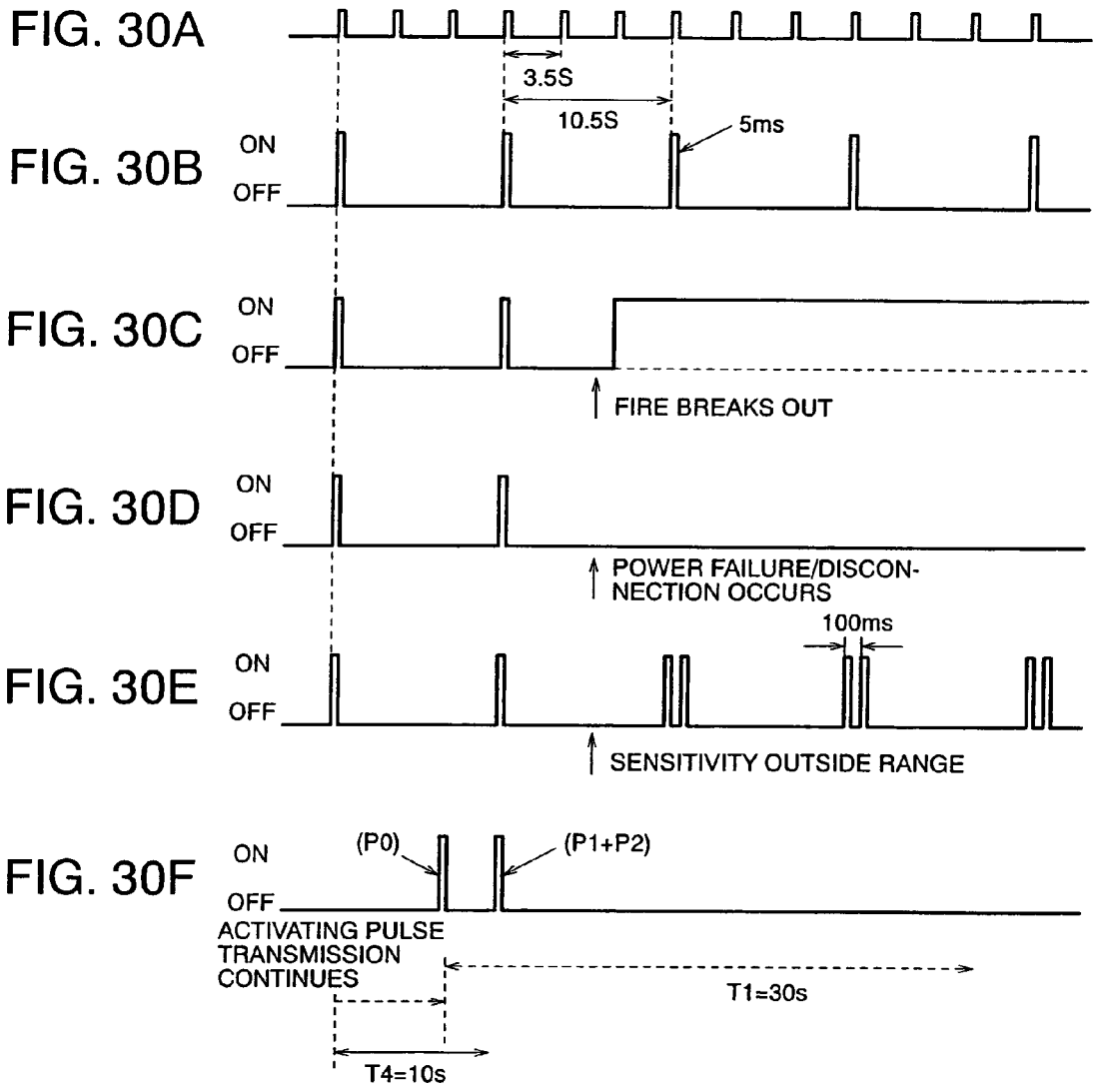
FIGS. 30A through 30F are timing charts explaining operation of a fire indicator lamp and a sensitivity data transmitting light-emitting element in the fire sensor according to Embodiment 2 of the present invention.

At S146, if it is determined that the disconnection flag F1 is switched on, the microcomputer 14 keeps the blinking transistor 17 switched off, and the operation proceeds to S150. Thus, the fire indicator lamp 16 is switched off, as shown in FIG. 30D, to visually warn that a disconnection failure has occurred or the power is off.

If it is determined at S146, that the disconnection flag F1 is switched off, the operation proceeds to S147 and determines whether the abnormality flag F2 is switched on.

At S147, if it is determined that the abnormality flag F2 is switched off, the operation proceeds to S148 and the microcomputer 14 outputs a normal pulsed light output to the blinking transistor 17, then proceeds to S150. Using this pulsed light output, the blinking transistor 17 is switched on pulsatingly and the fire indicator lamp 16 performs pulsed lighting, showing visually that the fire sensor 1A is operating normally. The pulsed lighting of the fire indicator lamp 16 is performed if the counter C1 is 0, the disconnection flag F1 is off, and the abnormality flag F2 is off, and is a blinking operation performing pulsed lighting cyclically at a rate of once every 10.5 seconds, as shown in FIG. 30B.

At S147, if it is determined that the abnormality flag F2 is switched on, the operation proceeds to S149 and the microcomputer 14 outputs two pulsed light outputs to the blinking transistor 17, then proceeds to S150. Then, when the two pulsed light outputs are output to the blinking transistor 17, the fire indicator lamp 16 performs double blinking in which pulsed lighting is performed twice in succession as shown in FIG. 30E, for example, which can clearly be distinguished from normal blinking, visually warning that the fire sensor 1A has abnormal sensitivity.

Next, at S150, the operation determines whether or not the activation flag F3 is switched on.

If it is determined that the activation flag F3 is switched on, the operation proceeds to S151 and switches the transmission flag F4 on, then proceeds to S152 and switches the activation flag F3 off, and then the operation returns to the initial phase and waits for TIME UP (S103). At S150, if it is determined that the activation flag F3 is off, the operation returns to the initial phase and waits for TIME UP (S103).

Thus, if the activating pulse has been received (i.e., if the activation flag F3 is switched on), after the next TIME UP (i.e., after 3.5 seconds), two pulses (P1+P2) having a pulse spacing Tw expressing the current sensitivity data are emitted by the sensitivity data transmitting light-emitting element 20. Transmission of this sensitivity data is performed regardless of the counter C1, and the pulsed lighting of the fire indicator lamp 16 is performed simultaneously with identical timing, such that it can be checked visually that the sensitivity data is being transmitted.

Here, S135 through S140 and S147 through S149 correspond to operations of the status information determining and outputting means 23, and S142 through S143 correspond to operations of the status information transmitting means 24.

Next, operation of the sensitivity tester 3A will be explained with reference to FIG. 29 and FIG. 17. Moreover, the flowchart shown in FIG. 29 is the operation of the microcomputer 37 for controlling the overall operation of the sensitivity tester 3A.

The sensitivity tester 3A is first started by switching the power on by a long push on the power switch 35. Thus, the microcomputer 37 performs an initialization (S161), then monitors for switch operation.

Then, at S162, if the power switch 35 is operated normally, mode switching is performed (S163), and photoelectric mode or ionization mode is selected depending on the fire sensor 1 to be measured for sensitivity, and the power and switching indicator lamp 31 lights up so as to correspond to the selected mode.

Next, at S164, the operation determines whether or not the activating pulse transmission and measurement start switch 46 has been switched on. If it is determined that the activating pulse transmission and measurement start switch 46 has been switched on, the operation proceeds to S165 and starts a timer T4, then proceeds to S166 and makes the activating pulse transmitting light-emitting element 45 emit light to transmit the activating pulse. Then, the operation proceeds to S167 and determines whether or not the response pulse P0 is present. This timer T4 is set to 10 seconds. Here, the activating pulse is transmitted continuously until the timer T4 completes a cycle (T4 TIME UP). Then, if the timer T4 completes a cycle without a response pulse P0 being received (S168), the operation proceeds to S186 and displays the error by lighting up the error indicator lamp 32.

As shown in FIG. 30F, if the response pulse P0 is received before the timer T4 completes a cycle, the operation proceeds to S169 and clears the timer T4, then proceeds to S170 and starts the timer T1, and then proceeds to S171 and waits for the first pulse P1 representing the sensitivity data. At this time, the timer T1 is set to 30 seconds, for example, and the operation waits for the first pulse P1 until the timer T1 completes a cycle (T1 TIME UP) (S172). Then, if the timer T1 completes a cycle, an error is returned, and the operation proceeds to S186 and displays the error by lighting up the error indicator lamp 32.

If the first pulse P1 is received at S171, a counter is started (S173), and the timer T1 is cleared (S174). Next, a timer T2 is started (S175), and the operation waits for the second pulse P2 representing the sensitivity data (S176). At this time, the timer T2 is set to 0.5 second, for example, and the operation waits for the second pulse P2 until the timer T2 completes a cycle (T2 TIME UP) (S177). Then, if the timer T2 completes a cycle, an error is returned, and the operation proceeds to S186 and displays the error by lighting up the error indicator lamp 32.

If the second pulse P2 is received at S176, the counter is stopped (S178), and the timer T2 is cleared (S179). Next, a timer T3 is started (S180), and the operation waits for a third pulse (S181). At this time, the timer T3 is set to 3.0 seconds, for example. Then, if a third pulse is received before the timer T3 completes a cycle (T3 TIME UP), a noise error is returned, the timer T3 is cleared (S182) and the operation proceeds to S186 and displays the error by lighting up the error indicator lamp 32. In other words, unnecessary pulses are detected, as shown in FIG. 17B, and the third pulse is recognized as a noise pulse Pn and displayed as an error.

Furthermore, if the timer T3 completes a cycle (T3 TIME UP) (S183) without a third pulse being received, as shown in FIG. 17A, the operation proceeds to S184. Then, the microcomputer 37 calculates the current sensitivity from the count value of the counter from start to stop and displays a numerical value for the current sensitivity (in %/ft) on the display 33 (S185). If the current sensitivity calculated from the count value is less than the sensitivity tolerance range, "00" is displayed on the display 33, and if greater, "88" is displayed on the display 33. Thus, a checker can recognize an abnormality in the sensitivity. At this time, the microcomputer 37 holds the acquired current sensitivity in the memory 39, and keeps it displayed on the display 33.

Thus, the sensitivity tester 3A performs a signal receiving operation for the sensitivity data from the fire sensor 1A based on the operation of the activating pulse transmission and measurement start switch 46, and displays the received current sensitivity on the display 33 (S185), or displays an error on the error indicator lamp 32 (S186). Thereafter, the microcomputer 37 returns to monitoring for a switch operation after performing an initialization. The operation described above is repeated every time the activating pulse transmission and measurement start switch 46 is operated. Moreover, when the activating pulse transmission and measurement start switch 46 is operated, the contents of the display 33 or the error indicator lamp 32 are cleared, and the current sensitivity stored in the memory 39 is also cleared.

If the timers T1, T2 or T4 complete a cycle (S168, S172, or S177), or if a third pulse is received before the timer T3 completes a cycle (S181), it is assumed that the response pulse P0 or the two pulses P1 and P2 representing the sensitivity data were not received properly, and the microcomputer 37 performs an error display by lighting up the error indicator lamp 32. Thus, the checker must execute the sensitivity measurement again by operating the activating pulse transmission and measurement start switch 46.

Infrared light may also be emitted as illumination from lighting equipment installed in the vicinity of the fire sensor 1A. If the infrared light from this lighting equipment is received by the sensitivity tester 3A, a third pulse, in other words, noise, will be received before the timer T3 completes a cycle. In that case, the error indicator lamp 32 lights up, and the checker can recognize the error visually. Then, the checker can execute the sensitivity measurement again by bringing the sensitivity tester 3A closer to the fire sensor 1A, enabling noise to be reliably removed.

Thus, according to Embodiment 2, the microcomputer 14 checks cyclically (every 3.5 seconds) whether or not the activating pulse has been received at the activating pulse receiving light-receiving element 27, and executes operations such as the status information transmitting means 24 and the status information determining and outputting means 23, etc., if the activating pulse is received. The sensitivity tester 3A generates the activating pulse from the activating pulse transmitting light-emitting element 45 continuously for a length of time (here, 10 seconds) that is greater than or equal to the above cycle. Thus, because the fire sensor 1A can check whether or not the activating pulse has been received, for example, within a timing corresponding to activation of the microcomputer 14, and the operations such as the status information determining and outputting means 23 and the status information transmitting means 24, etc., can be executed if the activating pulse is received, electric power consumption can be reduced.

The fire sensor 1A also transmits a response pulse P0 before the execution of operations such as the status information determining and outputting means 23 and the status information transmitting means 24, etc., if the activating pulse is received, and the sensitivity tester 3A stops transmission of the activating pulse and starts reception of sensitivity data signals if the response pulse P0 is received. Thus, the operation for reception of the sensitivity data by the sensitivity tester 3A is performed in synchrony with the operation for transmission of the sensitivity data by the fire sensor 1A, enabling the electric power consumption to be further reduced.

The MPU functioning as a controlling means for the microcomputer 14 checks cyclically (every 3.5 seconds) whether or not the activating pulse has been received at the activating pulse receiving light-receiving element 27, and executes operations relating to information acquisition (sensitivity acquisition) if the activating pulse is received. Specifically, if the activating pulse is received, the MPU executes operations relating to information acquisition in which a detecting portion is operated, output from the detecting portion is captured as an A/D value, and six captured A/D values are averaged and output as the current sensitivity. The sensitivity tester 3A generates the activating pulse from the activating pulse transmitting light-emitting element 45 continuously for a length of time (here, 10 seconds) that is greater than or equal to the above cycle. Thus, because the fire sensor 1A can check whether or not the activating pulse has been received, for example, within a timing corresponding to activation of the microcomputer 14, and the operations relating to information acquisition can be executed if the activating pulse is received, electric power consumption can be reduced.

The fire sensor 1A also transmits a response pulse P0 before the execution of operations relating to information acquisition if the activating pulse is received, and the sensitivity tester 3A stops transmission of the activating pulse if the response pulse P0 is received, and starts reception of information signals (sensitivity data). Thus, the operation for reception of the sensitivity data by the sensitivity tester 3A is performed in synchrony with the operation for transmission of the information signals by the fire sensor 1A, enabling the electric power consumption to be further reduced.

The angular transmission and reception ranges of the sensitivity data transmitting light-emitting element 20 and the activating pulse receiving light-receiving element 27 are set to wide-angled ranges, and the angular transmission and reception ranges of the sensitivity data receiving light-receiving element 34 and the activating pulse transmitting light-emitting element 45 are set to narrow-angled ranges. Thus, the working position of the sensitivity tester 3A is not limited, and reliable transmission and reception of signals can be performed without picking up noise components by directing a transmit and receive direction of the sensitivity tester 3A toward the fire sensor 1A.

A determination is made as to whether or not the current sensitivity is within the sensitivity tolerance range, and if determined to be outside the sensitivity tolerance range (abnormal sensitivity), two light pulses are emitted from the sensitivity data transmitting light-emitting element 20 with a pulse spacing Tw1 or Tw2, and the fire indicator lamp 16 is also double-blinked. Thus, because the checker can recognize the abnormal sensitivity from a display of "00" or "88" on the display 33 of the sensitivity tester 3A during inspection work on the fire sensor 1A, and can also recognize the abnormal sensitivity from the double blinking of the fire indicator lamp 16, it is possible to decide accurately if abnormal sensitivity has actually occurred.

Because sensitivity information lying within the sensitivity tolerance range and abnormality information not lying within the sensitivity tolerance range is transmitted using a single sensitivity data transmitting light-emitting element 20, the number of parts is reduced, enabling reductions in the cost and size of the fire sensor 1.

Moreover, double blinking of the fire indicator lamp 16 is used to warn that there is abnormal sensitivity, but the warning that there is abnormal sensitivity is not limited to double blinking the fire indicator lamp 16, and provided that the transmission of normal sensitivity information and the transmission of abnormal sensitivity can be distinguished, the number of blinks need only be different for the two.

A buzzer functioning as a sound element can also be disposed on the fire sensor 1 instead of the fire indicator lamp 16 for the warning means. Then, the buzzer can be sounded momentarily instead of the double blinking of the fire indicator lamp 16 only at the time of abnormal sensitivity.

A decision is made as to which grade of sensitivity level within the sensitivity tolerance range the current sensitivity is in, a pulse spacing Tw is set to match the grade of sensitivity level the current sensitivity is in, and the sensitivity data transmitting light-emitting element 20 is made to emit two pulses within a predetermined timing at the set pulse spacing Tw. Thus, the amount of light emission from the sensitivity data transmitting light-emitting element 20 is greatly reduced compared to conventional devices in which the sensitivity data is transmitted by making a light-emitting element emit light based on transmitted data in which the sensitivity data is encoded, enabling low power consumption.

Because thirty grades of sensitivity levels are obtained by dividing an upper limit region and a lower limit region of the sensitivity tolerance range densely, and dividing a central region of the sensitivity tolerance range sparsely, resolution in the upper limit region and the lower limit region of the sensitivity tolerance range is high, enabling the current sensitivity to be detected with high precision if the upper limit region or the lower limit region of the sensitivity tolerance range is reached. Thus, the detecting portion of the fire sensor 1A can be changed before the current sensitivity is outside the sensitivity tolerance range, enabling stable fire detection to be achieved.

Because the fire indicator lamp 16 is blinked in synchrony with the pulses transmitting the sensitivity data from the sensitivity data transmitting light-emitting element 20, the checker can check visually that the sensitivity data is being transmitted from the fire sensor 1A, facilitating sensitivity data inspection work.

Because the sensitivity tester 3A displays an error on the error indicator lamp 32 if three or more pulses are received within a predetermined timing, or if a pulse is received outside the predetermined timing, false detection of sensitivity data due to noise can be prevented. Thus, if an error is displayed by the error indicator lamp 32, accurate sensitivity data can be obtained with the influence of noise removed by performing the measurement again.

Moreover, in each of the above embodiments, thirty grades of sensitivity levels are explained as being obtained by dividing an upper limit region and a lower limit region of the sensitivity tolerance range densely, and dividing a central region of the sensitivity tolerance range sparsely, but the sensitivity level may also be obtained dividing the sensitivity tolerance range uniformly into thirty levels.

In each of the above embodiments, the number of grades of sensitivity level is not limited to thirty grades, and can be appropriately set based on specifications of the fire sensor 1.

In each of the above embodiments, pulse spacings Tw corresponding to the thirty grades of sensitivity levels for expressing current sensitivity are explained as being stored in an EEPROM 15 in advance, but the microcomputer 14 may also determine the current sensitivity to which the grade of sensitivity level among the thirty grades of sensitivity levels corresponds, then find a pulse spacing Tw corresponding to the grade of sensitivity level in question by calculation. In that case, the microcomputer 14 may also read out the upper limit (D3) and the lower limit (D2) of the sensitivity tolerance range stored in the EEPROM 15, and find the thirty grades of sensitivity levels by calculation based on the upper limit (D3) and the lower limit (D2) read out.

In each of the above embodiments, current sensitivity (sensitivity level) is explained as being represented by pulse spacing between two pulses, but the temporal factor of the pulses expressing the sensitivity level is not limited to pulse spacing, and they may also be represented by pulse duration, for example.

In each of the above embodiments, a sensitivity display is performed using a display 33, and an error display is performed using an error indicator lamp 32, but the sensitivity display and the error display may also both be performed using the display 33.

In each of the above embodiments, smoke detectors are explained as being used for the fire sensor, but the fire sensor is not limited to smoke detectors, and a heat sensor, etc., may also be used, for example.

In each of the above embodiments, double blinking of the fire indicator lamp 16 is used to warn that there is abnormal sensitivity, but the warning that there is abnormal sensitivity is not limited to double blinking the fire indicator lamp 16, and provided that the transmission of normal sensitivity information and the transmission of abnormal sensitivity can be distinguished, the number of blinks need only be different for the two.

In each of the above embodiments, sensitivity is explained as being used for the status information corresponding to the status of the detecting portion, but the status information corresponding to the status of the detecting portion is not limited to sensitivity, and for example, results representing normal operation or abnormal operation if an automatic test function is provided, a set address or serial number, type of fire sensor, operation history, etc., can be used.

What is claimed is:

1. A fire sensor status information acquisition system comprising:

a fire sensor comprising:

a sensor signal receiving element for receiving a trigger signal;

a sensor signal transmitting element; and a controlling means for checking cyclically whether or not said trigger signal has been received at said sensor signal receiving element and executing an operation relating to information acquisition if said trigger signal is received; and terminal equipment comprising a terminal equipment signal transmitting element for transmitting said trigger signal, said terminal equipment emitting said trigger signal from said terminal equipment signal transmitting element continuously for a length of time greater than or equal to said cycle of checking, wherein:

said controlling means transmits a response signal from said sensor signal transmitting element and executes an operation relating to said information acquisition if said trigger signal is received, then transmits an acquired information signal from said sensor signal transmitting element, said terminal equipment further comprises a terminal equipment signal receiving element;

said controlling means transmits said response signal from said sensor signal transmitting element before executing said operation relating to said information acquisition if said trigger signal is received; and said terminal equipment stops transmitting said trigger signal from said terminal equipment signal transmitting element and starts receiving said information signal through said terminal equipment signal receiving element if said terminal equipment signal receiving element receives said response signal.

2. The fire sensor status information acquisition system according to claim 1, wherein:

an angular transmitting and receiving range of said sensor signal receiving element and said sensor signal transmitting element is configured so as to have a wider angle than an angular transmitting and receiving range of said terminal equipment signal transmitting element and said terminal equipment signal receiving element.

* * * * *